US010731954B2

(12) United States Patent
Auld et al.

(10) Patent No.: US 10,731,954 B2
(45) Date of Patent: Aug. 4, 2020

(54) TARGET SYSTEM AND RELATED TARGET PANELS AND METHODS

(71) Applicant: Automated Target Solutions, Inc., Ivyland, PA (US)

(72) Inventors: Brian Auld, Lansdale, PA (US); Steven Phillip Auld, Furlong, PA (US); Harvey Albert Shuhart, III, Doylestown, PA (US); Nathan Lyman Walker, Ambler, PA (US)

(73) Assignee: Automated Target Solutions, Inc., Ivyland, PA (US)

( * ) Notice: Subject to any disclaimer, the term of this patent is extended or adjusted under 35 U.S.C. 154(b) by 229 days.

(21) Appl. No.: 15/151,664

(22) Filed: May 11, 2016

(65) Prior Publication Data

US 2016/0334195 A1 Nov. 17, 2016

Related U.S. Application Data

(60) Provisional application No. 62/159,589, filed on May 11, 2015.

(51) Int. Cl.
*F41J 5/044* (2006.01)
*F41J 7/06* (2006.01)

(52) U.S. Cl.
CPC ..... *F41J 5/044* (2013.01); *F41J 7/06* (2013.01)

(58) Field of Classification Search
CPC ..... F41J 7/00; F41J 7/02; F41J 7/04; F41J 5/041; F41J 5/042; F41J 5/044; F41J 5/048
See application file for complete search history.

(56) References Cited

U.S. PATENT DOCUMENTS

| | | | |
|---|---|---|---|
| 2,819,084 | A | 1/1958 | Brown et al. |
| 3,004,763 | A | 10/1961 | Knapp |
| 3,112,110 | A | 11/1963 | Schulman |
| 3,215,933 | A | 11/1965 | Scanlon, Jr. |
| 3,401,939 | A | 9/1968 | La Mura |

(Continued)

FOREIGN PATENT DOCUMENTS

WO 9504912 A1 2/1995

*Primary Examiner* — Jasson H Yoo
(74) *Attorney, Agent, or Firm* — O'Banion & Ritchey LLP; John P. O'Banion

(57) ABSTRACT

Disclosed is a reactive target system including at least one target panel supported by a respective target positioning unit, and a shooter communications device. The target panel includes first and second electrically conductive layers positioned between first and second outer reinforcement layers, and separated by an electrically insulating layer. The first electrically conductive layer includes a plurality of electrically isolated target zones and a corresponding plurality of electrical connection sites. The second electrically conductive layer provides a common conductor zone and a corresponding electrical connection site. Each of the electrical connection sites are configured to be pierced by and electrically couple to a respective electrical contact element of an attachment mechanism on the target positioning unit. The target positioning unit senses a projectile impact of a target zone of the target panel, moves the target panel between first and second positions, and is controlled by and communicates with the shooter communications device.

19 Claims, 22 Drawing Sheets

(56) References Cited

U.S. PATENT DOCUMENTS

| | | | | |
|---|---|---|---|---|
| 3,447,077 | A | 5/1969 | Loxley | |
| 3,529,828 | A | 9/1970 | Thalmann | |
| 3,580,579 | A | 5/1971 | Scharz et al. | |
| 3,854,722 | A | 12/1974 | Ohlund et al. | |
| 4,240,640 | A | 12/1980 | LaMura | |
| 4,244,583 | A * | 1/1981 | Wood | F41J 5/048 273/373 |
| 4,786,058 | A | 11/1988 | Baughman | |
| 4,828,269 | A | 5/1989 | Tessel | |
| 4,953,875 | A | 9/1990 | Sudit | |
| 5,516,113 | A | 5/1996 | Hodge | |
| 5,577,733 | A | 11/1996 | Downing | |
| 6,994,347 | B2 | 2/2006 | Tessel et al. | |
| 8,047,546 | B1 | 11/2011 | Klein | |
| 2003/0168812 | A1 | 9/2003 | Tessel | |
| 2014/0091816 | A1 | 4/2014 | Hodge | |
| 2015/0369572 | A1* | 12/2015 | Smolka | F41J 5/042 273/371 |
| 2016/0076859 | A1* | 3/2016 | Chester | F41J 5/14 273/386 |
| 2016/0209185 | A1 | 7/2016 | Ford | |
| 2016/0327377 | A1 | 11/2016 | Flynn | |

* cited by examiner

TARGET SYSTEM AND RELATED TARGET PANELS AND METHODS

CROSS-REFERENCE TO RELATED APPLICATION

This application claims priority to U.S. Provisional Application Ser. No. 62/159,589, filed May 11, 2015, the disclosure of which is hereby incorporated by reference herein in its entirety.

TECHNICAL FIELD

The present invention relates generally to shooting target systems, and more particularly, to shooting target systems that sense projectile hits.

BACKGROUND

The general concept of using the electrical conductivity of a projectile to track "hits" on a target is well known within the art. The basic premise is that a projectile made of metal or other conductive material passes through two conductive and electrically isolated layers of a target and completes a circuit. This electrical signal is then passed from the target to another apparatus in order to track the hit.

Much of the prior art is focused on design and construction of the target itself, rather than system features required to operate the targets and track hits. For example, U.S. Pat. No. 4,828,269, issued May 9, 1989, shows a hit-scoring target for shooting practice having several mutually bonded layers. A first layer, at least the outside surface of which is electrically conductive, a second, electrically nonconductive and at least semi-rigid layer imparting mechanical strength to the first layer and made of a material tolerant of the heat of a freshly fired projectile, a third, electrically nonconductive layer made of an elastically resilient material, a fourth layer of which at least the surface contacting the third layer is electrically conductive, and a fifth layer serving as a backing and imparting relative rigidity to the target. The distance between the electrically conductive surfaces of the first and the fourth layer is smaller than the length of the shortest projectile to be fired at the target, whereby a projectile hitting, penetrating, and passing through the target causes a transient electrical low-resistance connection to be established between the electrically conductive surfaces.

U.S. Pat. No. 4,240,640, issued Dec. 23, 1980, shows an electrical, projectile penetration-sensing target made of a pair of laminated sheets including a polymer resin coated brittle, calendered aluminum wire screen, and a polymer resin coated, fiberglass web. The laminated sheets are separated by and bonded to a sheet of small celled foamed polypropylene. The wire screens are electrically connected to a resistance responsive network whose output is a relatively wide pulse, which is coupled to a recording device.

U.S. Pat. No. 3,854,722, issued Dec. 17, 1974, shows a target with pairs of penetrable, electrical-conductive sheet-like elements that are flatwise opposed and spaced apart a distance to be transiently electrically connected by a penetrating projectile. Each pair corresponds to an annular scoring zone. Elements for radially outer scoring zones are on a permanent front sheet-like structure; those for inner ones are on a readily replaceable sheet-like structure installed behind the front one. To accommodate possible misalignment of the sheet-like structures, the radially innermost elements on the front structure partially radially overlap the radially outermost ones on the rear one. Such overlapping elements cooperate for one scoring zone, and corresponding ones of them on the two structures are electrically interconnected.

Other target systems have focused on target holding devices. For example, U.S. Pat. No. 6,994,347, issued Feb. 7, 2006, provides a hit-scoring apparatus for shooting practice, comprising a target holder with a body constituting the first and second jaws of a clamping device. The first jaw and the second jaw are electrically insulated from one another, with means adapted to produce a relative movement between the first jaw and the second jaw. A target panel is clampable between the first and second jaws. The target panel has a plurality of layers, including an electrically conductive front layer and an electrically conductive second layer separated and spaced apart from the front layer by at least one electrically non-conductive layer. When the target panel is clamped between the first and second jaws of the target holder, separate electrical contacts are established between the front layer and the first jaw on the one hand, and between the second layer and the second jaw on the other hand. The first and second jaws are connectable to a hit-scoring unit.

U.S. Pat. No. 8,047,546, issued Nov. 1, 2011, shows a target holder assembly for interchangeably supporting a two-dimensional target and a three-dimensional target. It includes an enclosure and a target holder frame connected to the enclosure. The target holder frame has a cross arm member connected between two target arms. The cross arm has a base length with clamping members extending from both ends of the base length to engage three dimensional targets. The cross arm also has receiving grooves proximate the junction of the clamping members and the base length positioned to engage the two-dimensional targets. A front protrusion is positioned along the base length to engage either the two-dimensional target or the three-dimensional target. The holder assembly further includes a clamping apparatus connected to the base length to engage either the two-dimensional target or the three-dimensional target.

Known hit-sensing target systems are deficient for various reasons, including inadequate target durability, excessively high costs per target, inability to be easily serviced by users in the field, lack of portability, lack of ability to adequately track shooting performance, and lack of ability to control target positioning during a shooting event, for example. Accordingly, there is a need for improvements to known target systems to address these and other deficiencies.

SUMMARY OF THE INVENTION

A target panel according to an exemplary embodiment for use with a target system that senses impacts of the target panel by projectiles fired by a shooter includes an outer reinforcement layer, first and second electrically conductive layers, and an electrically insulating layer. The first electrically conductive layer is positioned behind the outer reinforcement layer and has a plurality of electrically isolated target zones and a plurality of electrical connection sites, each electrical connection site corresponding to a respective one of the target zones. The second electrically conductive layer is positioned behind the first electrically conductive layer and provides a conductor zone and an electrical connection site corresponding to the conductor zone, the conductor zone being positioned to electrically couple to each of the target zones when the target panel is impacted by a projectile. The electrically insulating layer is positioned between the first and second electrically conductive layers. Each of the electrical connection sites of the first and second electrically conductive layers are electrically isolated from one another and are configured to be pierced by and electrically couple to a respective electrical contact element of an attachment mechanism.

A target system according to an exemplary embodiment for sensing impacts of a target panel by projectiles fired by a shooter includes at least one target panel having one or more target zones, and at least one target positioning unit that moves the at least one target panel between a first position and a second position. The at least one target positioning unit includes a base, an arm movably coupled to the base and having a support structure that supports the target panel, an actuator coupled to the arm and operable to move the arm and the target panel between the first position and the second position, and a controller that controls the actuator and detects a projectile impact of the target panel.

A method according to an exemplary embodiment for interacting with a target system is also disclosed. The target system includes at least one target panel having one or more target zones and at least one target positioning unit that supports the at least one target panel and has a controller. The method includes sensing, via the controller, a projectile impact of a target zone of the plurality of target zones of the at least one target panel, and identifying, via the controller, the target zone as an impacted target zone. In response to identifying the impacted target zone, the controller generates a signal that corresponds to the projectile impact of the impacted target zone. The controller transmits the signal to a receiving device. In an embodiment, the system may further include a shooter communications device that receives the signal and displays to the shooter data corresponding to the projectile impact of the impacted target zone.

Various additional features and advantages of the invention will become more apparent to those of ordinary skill in the art upon review of the following detailed description of one or more illustrative embodiments taken in conjunction with the accompanying drawings. The drawings, which are incorporated in and constitute a part of this specification, illustrate one or more embodiments of the invention and, together with the general description given above and the detailed description given below, serve to explain the one or more embodiments of the invention.

BRIEF DESCRIPTION OF THE DRAWING

Like reference numerals are used to indicate like parts throughout the various figures of the drawing, wherein.

DETAILED DESCRIPTION OF THE INVENTION

Figure 1:
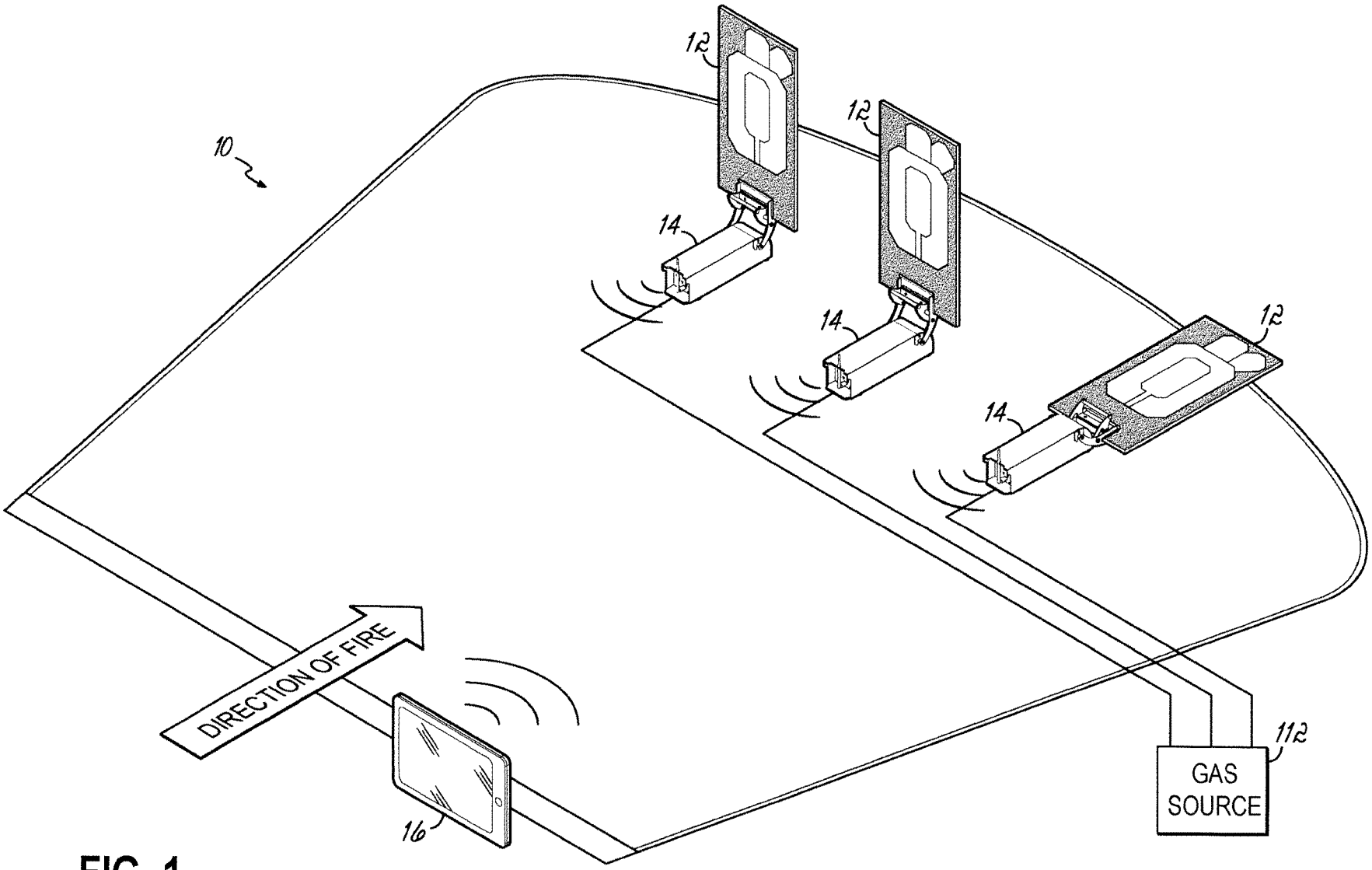
FIG. 1 is a schematic view of a target system according to an exemplary embodiment of the invention.

Referring to the various figures of the drawing, and first to FIG. 1, a target system 10 according to an exemplary embodiment of the invention is shown in a shooting range setting. The target system 10 generally includes one or more target panels 12 that each provide a target image to a shooter, and respective target positioning units 14 that support and move the target panels 12 between first and second positions.

As described in greater detail below, each target positioning unit detects (or "senses") projectile impacts (or "hits") of one or more target zones of its respective target panel 12, and may take various actions in response to detecting projectile impacts. Such responsive actions may include repositioning the target panel 12 between first and second positions, and communicating information relating to the projectile impacts to a shooter communications device 16, so as to provide real-time tracking of shooting performance. The target system 10 exhibits additional benefits including portability, durability in common target shooting field conditions, cost-effectiveness with a low cost per projectile, serviceability in the field with minimal tools, and adaptability to integrate multiple targets into a single complex shooting scenario, for example.

The Target Panel

Referring now also to FIGS. 2A-3C, the target panel 12 may be constructed of a plurality of layers that facilitate sensing of projectile impacts. In an exemplary embodiment, as described below, the target panel 12 may include first and second electrically conductive layers 18, 20 spaced apart and configured to be electrically coupled together by a conductive projectile (as shown in FIG. 2C) that pierces the target panel 12. This electrical coupling allows an electrical current to flow between the first and second electrically conductive layers 18, 20, which is then detected by the target positioning unit 14 for identifying and logging a projectile impact.

It will be understood that the term "panel," as used herein in combination with target panel 12, is not limiting to planar structures. Rather, the target panels 12 may be formed with various convex and/or convex curvatures or other features that provide the target panels 12 with a three dimensional presence.

Figure 2A:
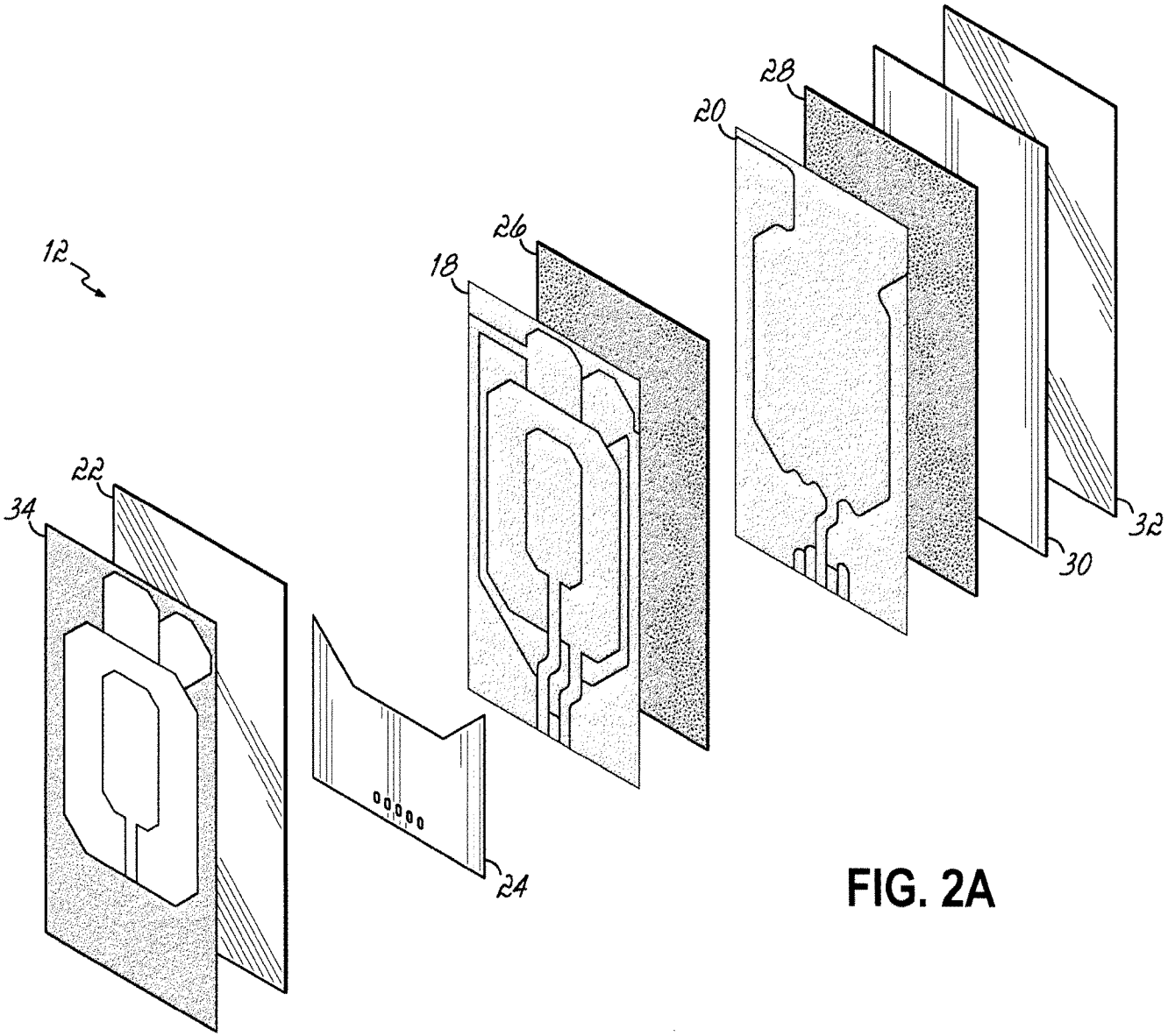
FIG. 2A is a schematic view showing details of a target panel of the target system of FIG. 1.
Figure 2B:
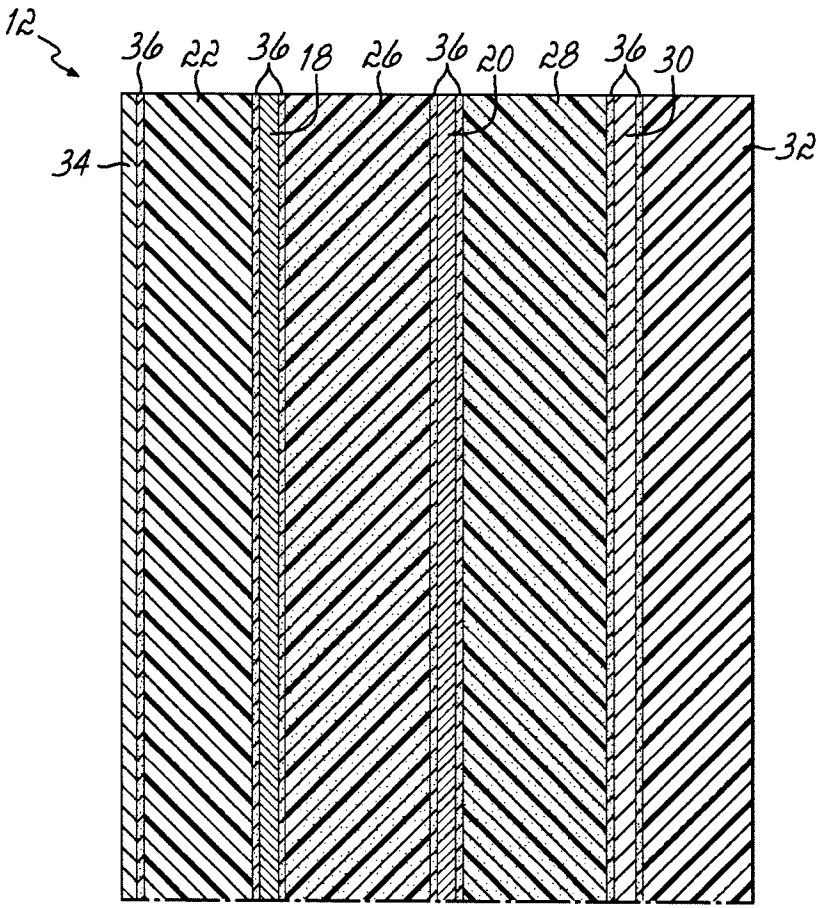
FIG. 2B is a schematic cross-sectional view of an upper portion of the target panel of FIG. 2A.
Figure 2C:
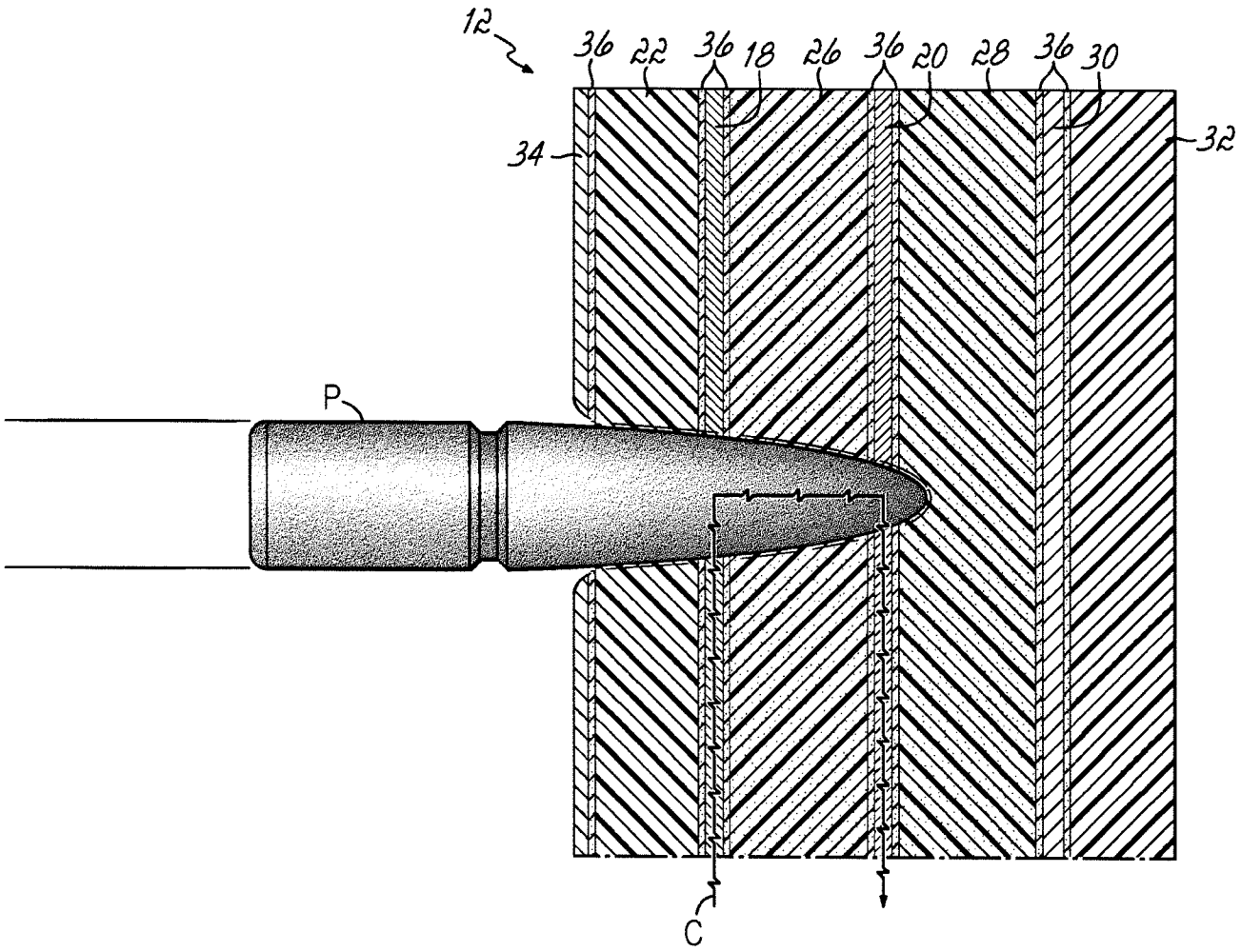
FIG. 2C is a schematic cross-sectional view similar to FIG. 2B, showing the target panel being pierced by a projectile which establishes an electrical circuit.

Referring to FIGS. 2A-2C, the layers of the target panel 12 may include a first outer reinforcement layer 22 positioned in front of the first electrically conductive layer 18. A first inner reinforcement layer 24, which may be constructed of paper, is positioned between the first outer reinforcement layer 22 and the first electrically conductive layer 18. The first inner reinforcement layer 24 may be sized to expand across only a lower portion of the target panel 12, including the location at which the target panel 12 is mounted to and clamped by the target positioning unit 14. A first electrically insulating layer 26 is positioned between and electrically isolates the first and second electrically conductive layers 18, 20. A second electrically insulating layer 28 is positioned behind the second electrically conductive layer 20. The electrically insulating layers 26, 28 may be constructed of extruded polystyrene foam, for example.

A second inner reinforcement layer 30 is positioned between the second electrically insulating layer 28 and a second outer reinforcement layer 32 positioned behind the second electrically insulating layer 28. The second paper reinforcement layer 30 may be formed of paper, and functions as a backing layer to enhance the rigidity to the target panel 12. Printed indicia 34 may be arranged on a front surface of the target panel 12 so as to provide the shooter with a visual representation of target zones, described below, defined by the first electrically conductive layer 18. The layers 18-34 may be joined together using any suitable adhesive 36, such as a water-based adhesive, for example.

The first and second outer reinforcement layers 22, 32 enhance the rigidity and durability of the target panel 12 so that it may withstand up to multiple hundreds of projectile impacts without premature spalling that requires target panel replacement. More specifically, the outer reinforcement layers 22, 32 provide the target panel 12 with sealed front and back surfaces that function to contain damaged inner portions of the target panel 12 struck by projectiles, including pierced portions of the first and second electrically conductive layers 18, 20, thereby substantially extending the useful life of the target panel 12. In one embodiment, one or both of the outer reinforcement layers 22, 32 may be formed of a polymeric material. For example, the first outer reinforcement layer 22 may be formed of polypropylene and the second outer reinforcement layer 32 may be formed of polyethylene. It will be appreciated that in alternative embodiments the outer reinforcement layers 22, 32 may be formed of various alternative materials suitable to provide rigidity and damage-containment benefits. Further, the exemplary materials comprising the disclosed layers 18-34 of the target panel 12 provide a cost-effective construction that allows for incurring minimal costs during eventual replacement of target panels 12 in an existing target system 10.

The first and second electrically conductive layers 18, 20 may be formed of any suitable electrically conductive material, such as aluminum, applied as a foil or a liquid spray, for example. As shown in FIG. 3C, when an electrically conductive projectile P pierces the target panel 12, the projectile P momentarily contacts the first and second electrically conductive layers 18, 20 simultaneously. As a result, the first and second conductive layers 18, 20 are electrically coupled together so as to complete an electrical circuit, and an electrical current C is allowed to flow between the first and second conductive layers 18, 20, through the conductive projectile P. As described below, a controller (84) of the target positioning unit 14 detects this flow of electrical current C and, in response, identifies the target panel 12 as having been impacted by the projectile P.

To ensure that an electrical circuit may be established, the first electrically insulating layer 26 may be formed with a thickness that is less than the length of the shortest projectile P expected to be fired at the target panel 12. In this regard, it will be appreciated that the thicknesses of the adhesive layers 36 shown herein are exaggerated for illustrative purposes, and in construction may be nominal with respect to the thicknesses of other layers such as the first electrically insulating layer 26.

In some embodiments, an electrical circuit may be established even when the projectile P is shorter than the distance between the first and second electrically conductive layers 18, 20. Specifically, while piercing the target panel 12 the projectile P may transfer electrostatic charge between the first and second conductive layers 18, 20 without actually contacting the conductive layers 18, 20 simultaneously. Consequently, the target system 10 may still detect impacts of the target panel 12 by various types of small projectiles, such as bird shot for example, that are otherwise too small to electrically couple the first and second conductive layers 18, 20 via simultaneous, direct physical contact.

Figure 3A:
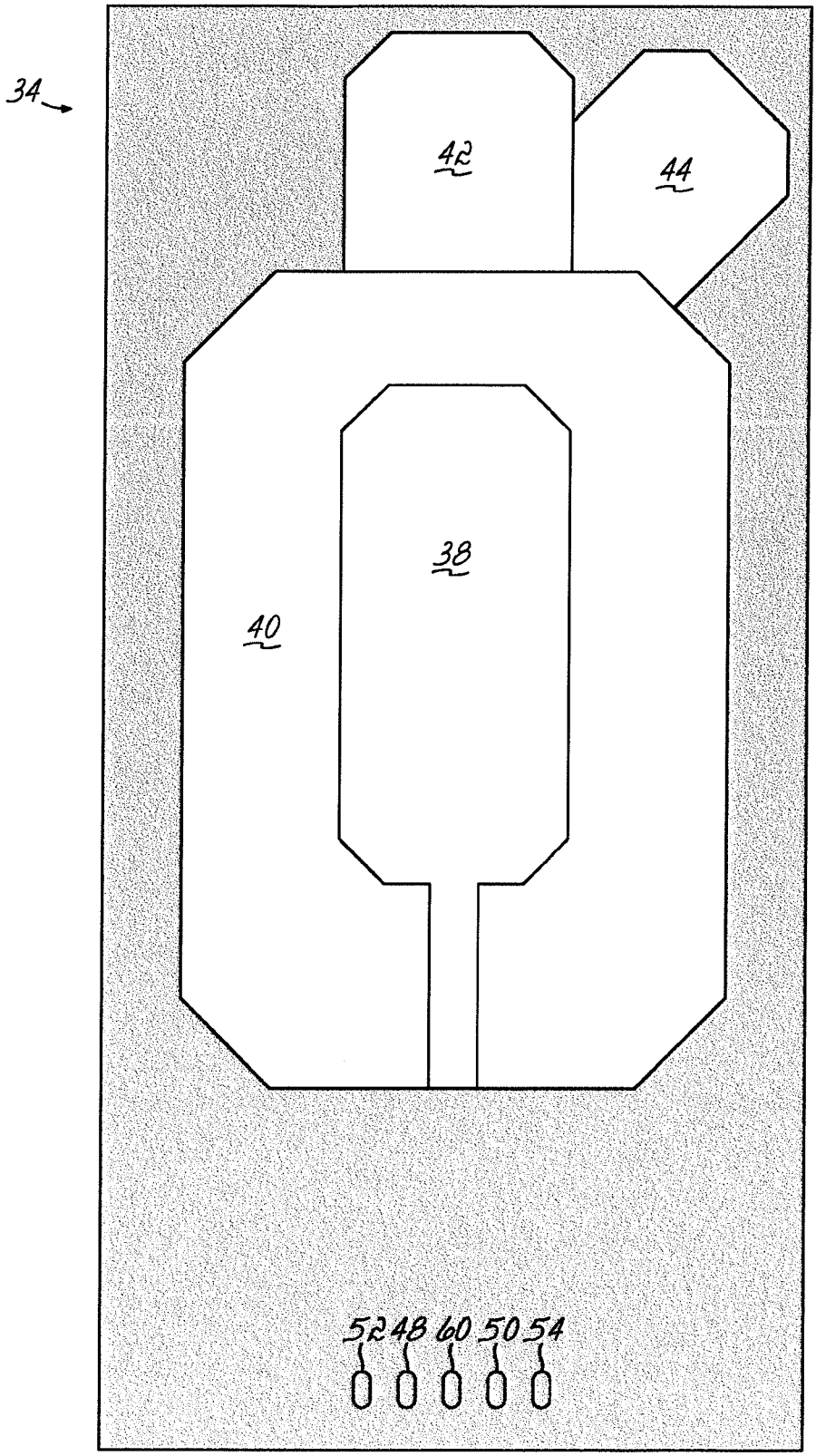
FIG. 3A is a front view of printed indicia applied to a front surface of the target panel of FIG. 2A.
Figure 3B:
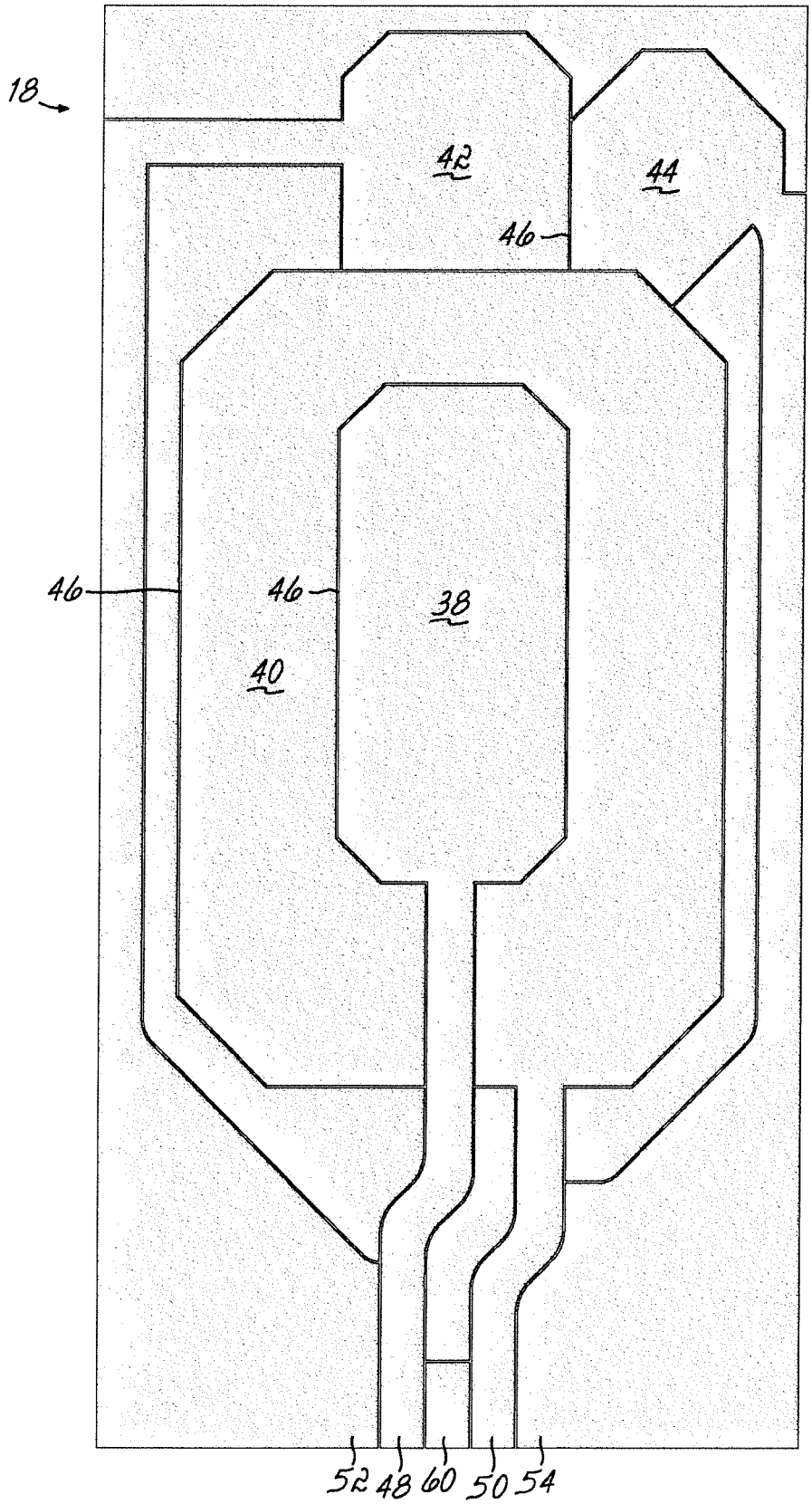
FIG. 3B is a front view of a first electrically conductive layer of the target panel of FIG. 2A.
Figure 3C:
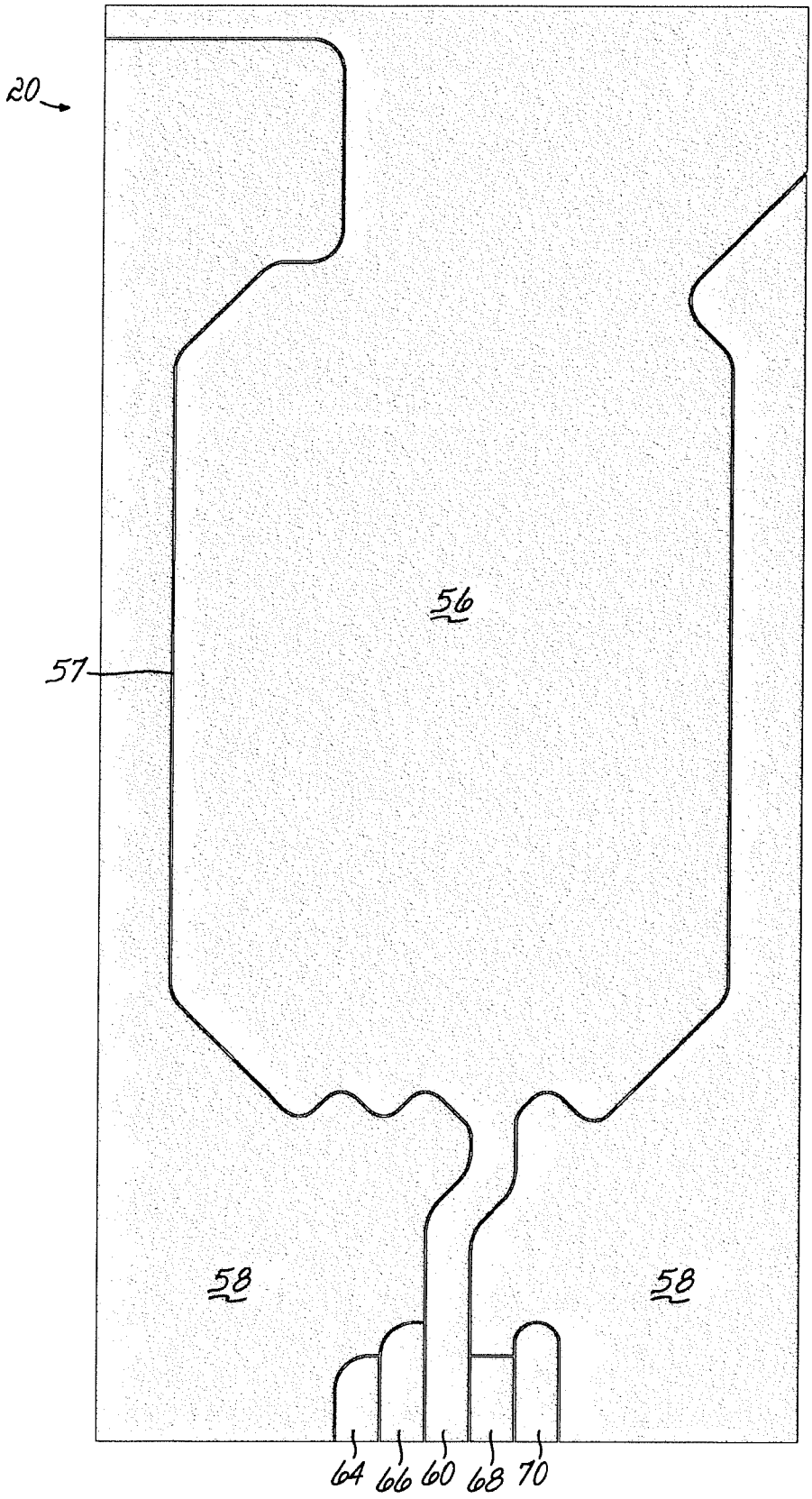
FIG. 3C is a front view of a second electrically conductive layer of the target panel of FIG. 2A.

Referring to FIGS. 3A and 3B, the first electrically conductive layer 18 (shown in FIG. 3B) of the target panel 12 may have a plurality of electrically isolated, die-cut target zones 38, 40, 42, 44 to allow for impact (or "hit") recognition in different portions of the target panel 12. Each of the target zones 38, 40, 42, 44 is visually represented to the shooter via the printed indicia 34 (shown in FIG. 3A) provided on the front surface of the target panel 12, and may correspond to a respective portion of one or more identifiable objects, such as a human figure. In the exemplary embodiment shown, the target panel 12 includes an inner body target zone 38, an outer body target zone 40, a first head target zone 42, and a second head target zone 44. It will be appreciated that in alternative embodiments the target panel 12 may be constructed with target zones of various other quantities, shapes, and arrangements.

As shown in FIG. 3B, the target zones 38, 40, 42, 44 of the first electrically conductive layer 18 are electrically isolated from one another by gaps 46 formed in the first conductive layer 18, which may extend into the underlying first electrically insulating layer 26. The gaps 46 trace the boundary of each target zone 38, 40, 42, 44 so as to physically separate the target zones 38, 40, 42, 44 from one another. The first electrically conductive layer 18 also includes a plurality of electrical connection sites 48, 50, 52, 54 arranged at a lower end of the target panel 12, and which correspond respectively to and electrically communicate with the target zones 38, 40, 42, 44. The electrical connection sites 48, 50, 52, 54 are electrically isolated from one another via gaps 46. In an alternative embodiment, the target panel 12 may be formed with a single target zone and corresponding electrical connection site.

Referring to FIG. 3C, the second electrically conductive layer 20 provides a common conductor zone 56 having a surface area that at least partially overlaps each of the surface areas defined by the target zones 38, 40, 42, 44 of the first electrically conductive layer 18. The common conductor zone 56 is defined by a gap 57 tracing an outer boundary that physically separates, and electrically isolates, the common conductor zone 56 from an outer portion 58 of the second conductive layer 20. The gap 57 may extend into the underlying second electrically insulating layer 28. The second conductive layer 20 includes a single electrical connection site 60 that corresponds to and electrically communicates with the common conductor zone 56.

While the exemplary second conductive layer 20 shown herein includes a single conductor zone 56 and a single electrical connection site 60, in alternative embodiments the second conductive layer 20 may include multiple conductor zones and multiple corresponding electrical connection sites. For example, the second conductive layer 20 may include one or more conductor zones and corresponding electrical connection sites that are assigned to, and at least partially overlap, each of the target zones 38, 40, 42, 44 of the first conductive layer 18.

As described in greater detail below, each of the electrical connection sites 48, 50, 52, 54 is configured to be pierced, from a front side of the target panel 12, by a respective electrical contact element (see FIGS. 6-11) of the target positioning unit 14. In this manner, the target zones 38, 40, 42, 44 and the common conductor zone 56 are individually electrically coupled to a controller (84) of the target positioning unit 14, which detects an electrical current flowing through a particular target zone 38, 40, 42, 44 when pierced by a conductive projectile, and thus identifies the target zone 38, 40, 42, 44 as having been impacted. As shown in FIG. 3A, the electrical connection sites 48, 50, 52, 54 may be visually represented on the printed indicia 34 with corresponding markings, to assist a user with properly aligning the target panel 12 with the target positioning unit 14 during mounting.

The target panel 12 may be constructed so that electrical contact elements piercing the target panel 12 do not form a standing electrical connection between the target zones 38, 40, 42, 44 of the first electrically conductive layer 18 and the common conductor zone 56 of the second electrically conductive layer 20. Such an arrangement would undesirably provide the target positioning unit 14 with a false, lasting indication of a projectile impact of one or more of the target zones 38, 40, 42, 44.

Figure 10:
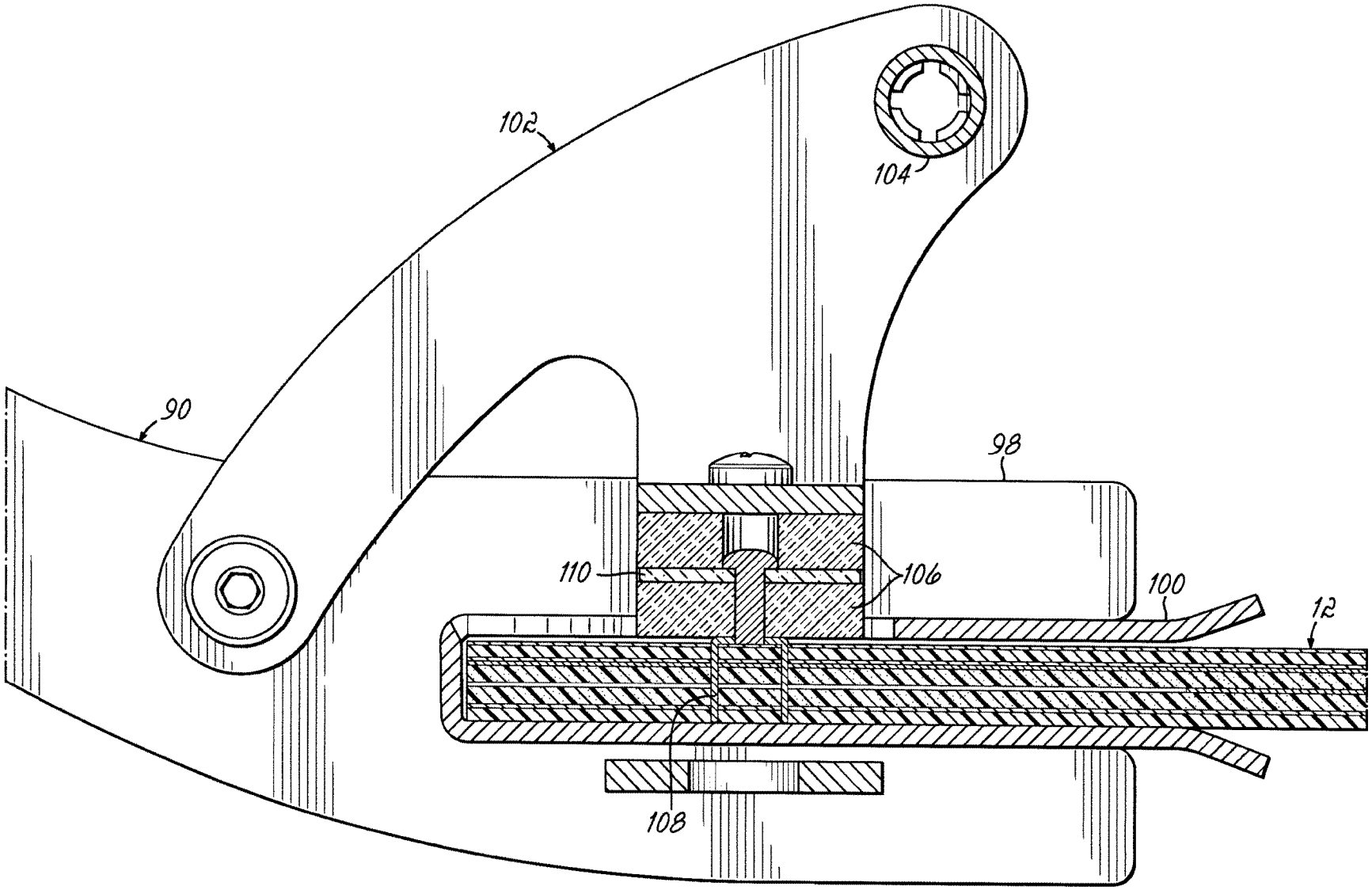
FIG. 10 is a cross-sectional view taken along line 10-10 in FIG. 9, showing details of an electrical contact element of the clamp pierced through layers of the target panel, shown schematically.
Figure 11:
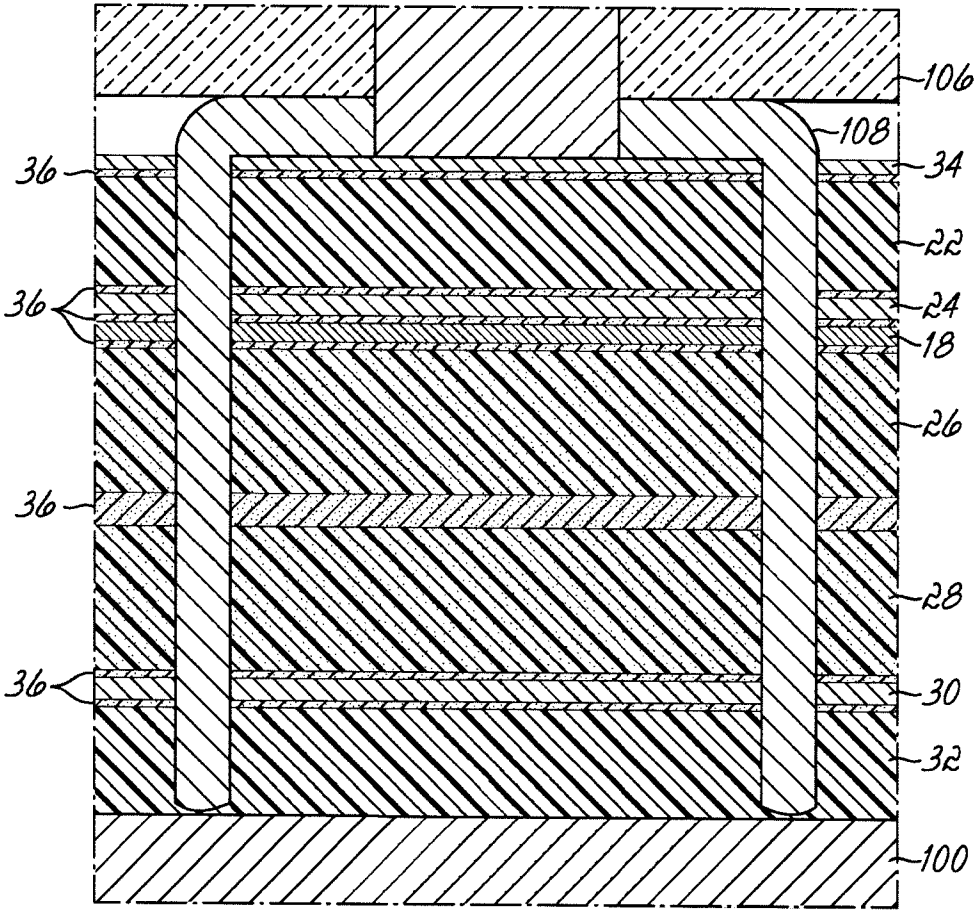
FIG. 11 is an enlarged view of an electrical contact element of the clamp pierced through layers of the target panel, shown schematically.

To prevent the issue described above, the first electrically conductive layer 18 may include an electrically isolated region 62 that aligns with (e.g., overlaps) the single connection site 60 of the second electrically conductive layer 20. Similarly, the second electrically conductive layer 20 may include electrically isolated regions 64, 66, 68, 70 that align with (e.g., overlaps) the electrical connection sites 48, 50, 52, 54 of the first electrically conductive layer 18. For example, in the embodiment shown in FIGS. 3B and 3C, the electrically isolated regions 62, 64, 66, 68, 70 may include conductive material that is physically separated via gaps 46, and thus electrically isolated, from the remaining portions of the respective first or second electrically conductive layer 18, 20. In another embodiment, as shown in FIGS. 10 and 11, the electrically isolated regions 62, 64, 66, 68, 70 may be left completely devoid of conductive material so as to define non-conductive open spaces. As a result of this construction, electrical current is allowed to pass between the first and second conductive layers 18, 20 only when the target panel 12 is pierced by a projectile, thereby providing hit-sensing capabilities for tracking shooting performance.

While target panel 12 is shown and described as a conductive target that enables hit-sensing via first and second electrically conductive layers 18, 20 that contact a conductive (e.g., metallic) projectile, the target panel 12 may be formed with various alternative constructions that enable similar hit-sensing abilities for non-conductive (e.g., non-metallic) projectiles. For example, the target panel 12 may be formed as a pressure-sensitive target that includes a plurality of target zones having one or more respective pressure sensors that detect pressures exerted on the target zone, and send signals to the target positioning unit controller (84) relating to the exerted pressures. The controller (84) may then identify a projectile impact based on the detection of a pressure differential (e.g., elevated pressure) over time.

The Target Positioning Unit

Figure 4:
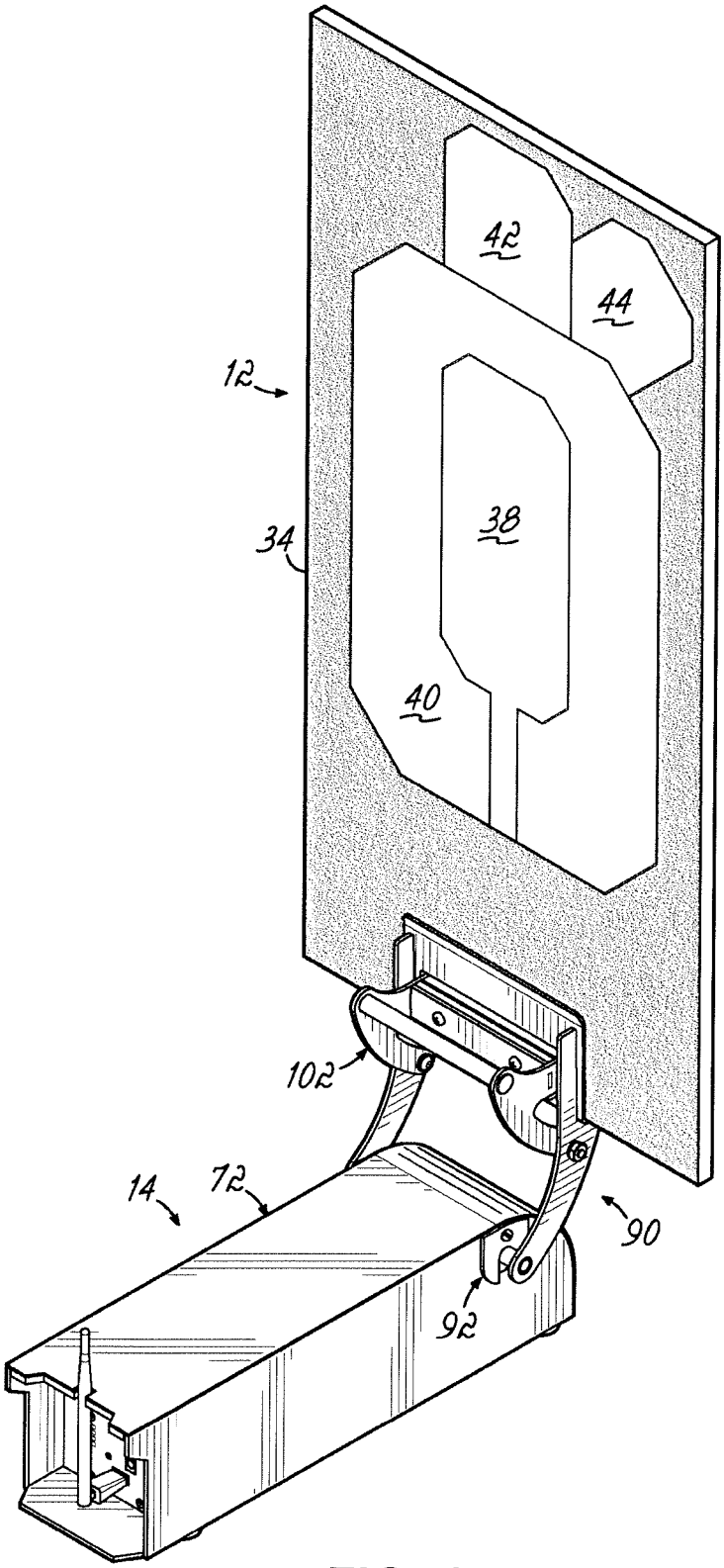
FIG. 4 is a perspective view of a target positioning unit supporting a corresponding target panel of the target system of FIG. 1 in an exemplary deployed position.

Referring now also to FIGS. 4-11, and beginning with FIG. 4, the target positioning unit 14 supports the target panel 12 at a lower end so that it may be presented to a shooter. The target positioning unit 14 is operable to detect projectile impacts of the target panel 12, as well as reposition the target panel 12 between first and second positions in response to detection of projectile impacts, as described below.

Figure 5:
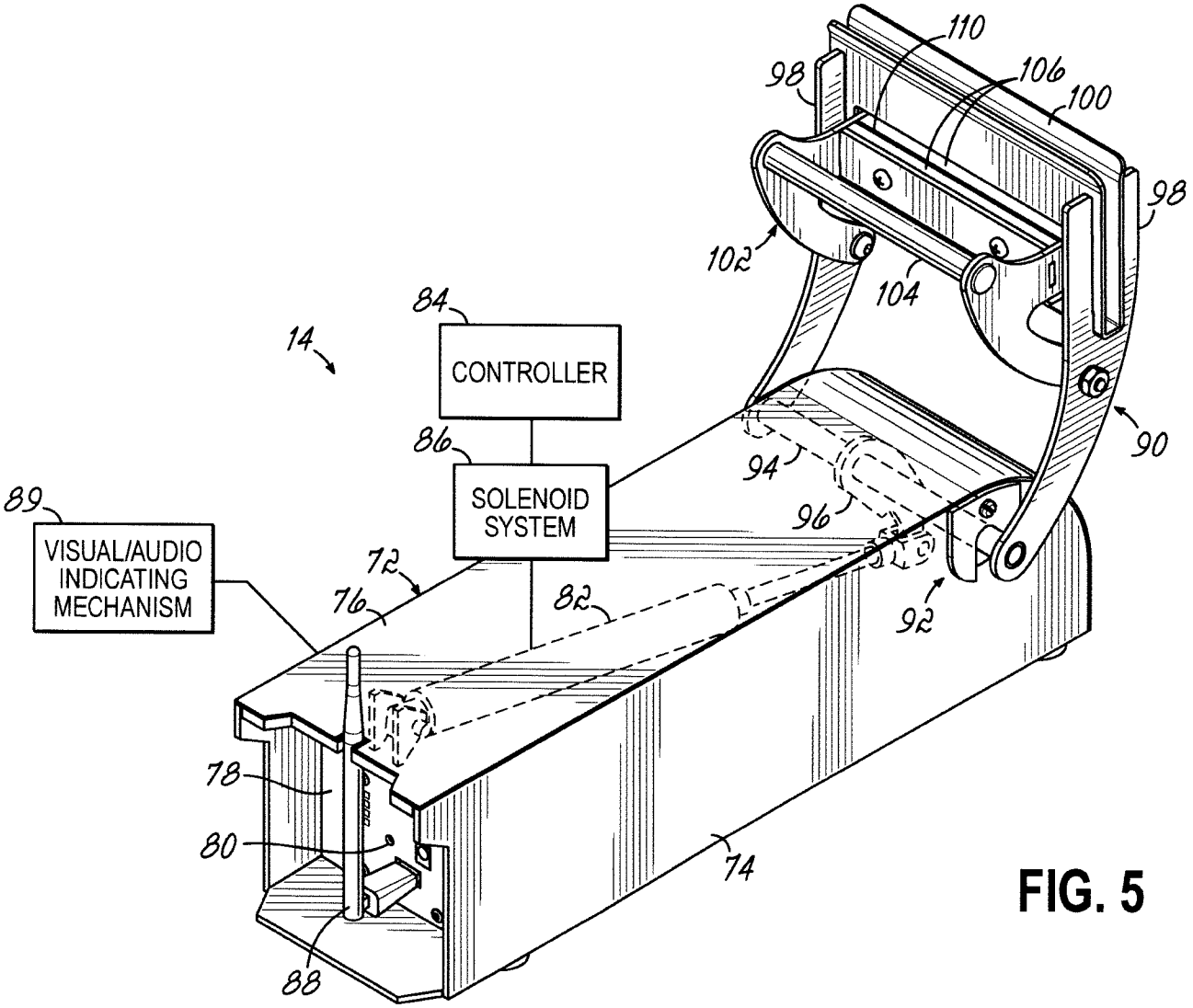
FIG. 5 is a perspective view of the target positioning unit of FIG. 4.

As shown in FIGS. 4 and 5, the target positioning unit 14 includes a housing 72 having a lower body 74, an upper lid 76 attached to the lower body 74 and removable for exposing an interior of the housing 72, and a front panel 78. The front panel 78 may support, for example, an On/Off switch, indicator lights, and various ports for electronic and pneumatic connections, including an external trigger port 80 for coupling with an external trigger device, as described in greater detail below in connection with FIGS. 17 and 18.

The housing 72 encloses within its interior an actuator, shown in the form a pneumatic cylinder 82, and electronic components of the target positioning unit 14. The electrical components include a controller 84 and a multi-valve solenoid system 86 that directs compressed gas from an external gas supply, described below, to the pneumatic cylinder 82. The housing 72 may further enclose a rechargeable, removable battery (not shown) that powers the electronic components, including the controller 84 and the solenoid system 86.

The target positioning unit 14 may further include a wireless communications module 88, such as a Wi-Fi adapter for example, removably coupled to the controller 84 at the front panel 78. The wireless communications module 88 enables the controller 84 to communicate with the shooter communications device 16 and with the controllers 84 of other target positioning units 14. As shown in FIGS. 4 and 5, the wireless communications module 88 may extend at least partly externally of the housing 72 so as to maximize its wireless operating range.

The target positioning unit 14 may further include a visual/audio indicating mechanism 89 coupled to the controller 84 and operable to provide to a shooter visual and/or audio signals that inform of shooting performance, for example when one or more of the target zones 38, 40, 42, 44 has been impacted by a projectile one or more times. In exemplary embodiments, the indicating mechanism 89 may include one or more light emitting elements (e.g., a light emitting diode, or "LED") and/or one or more sound emitting elements (e.g., a speaker) that emit corresponding visible and audible signals directed to and observed by the shooter. The indicating mechanism 89 may be controlled by the controller 84 to provide various types of blinking, flashing, strobing, or other visual effects, for example, and/or various types of beeps, sirens, horns, rings, or other audio effects, for example.

A movable arm assembly 90 is pivotably coupled to the housing 72 with a pivot assembly 92, including a pivot axle 94 that is coupled to an end of the pneumatic cylinder 82 via a pivot lever 96. As described below, the pneumatic cylinder 82 is controlled to move the arm assembly 90 and the target panel 12 between first and second positions. In the exemplary embodiment shown, the pivot axle 94 is oriented horizontally so as to define a horizontal pivot axis about which the arm assembly 90 pivots for moving the target panel 12 between a vertical deployed position and a horizontal retracted position. In alternative embodiments, the pivot axle 94 may be mounted in various other orientations to enable alternative pivoting movements of the arm assembly 90 and target panel 12. For example, the pivot axle 94 may be mounted vertically so that arm assembly 90 and target panel 12 pivot about a vertical axis. In further alternative embodiments, the target positioning unit 14 may be provided with various alternative combinations of guided-movement mechanisms, such as movable carriages and tracks for example, to achieve any desired first and second positions of the target panel 12, and corresponding transitional movements.

The arm assembly 90 includes a pair of elongate claws 98 that support an elongate channel member 100 at their distal ends. The channel member 100 is oriented generally transverse to the claws 98, and receives and supports the target panel 12 as shown in FIG. 4. The arm assembly 90 further includes a clamp 102 that is pivoted by a handle 104 relative to the claws 98 between an open position and a closed position. As described below, the clamp 102 electrically connects the target panel 12, including its conductive layers 18, 20, to the target positioning unit 14.

Figure 6:
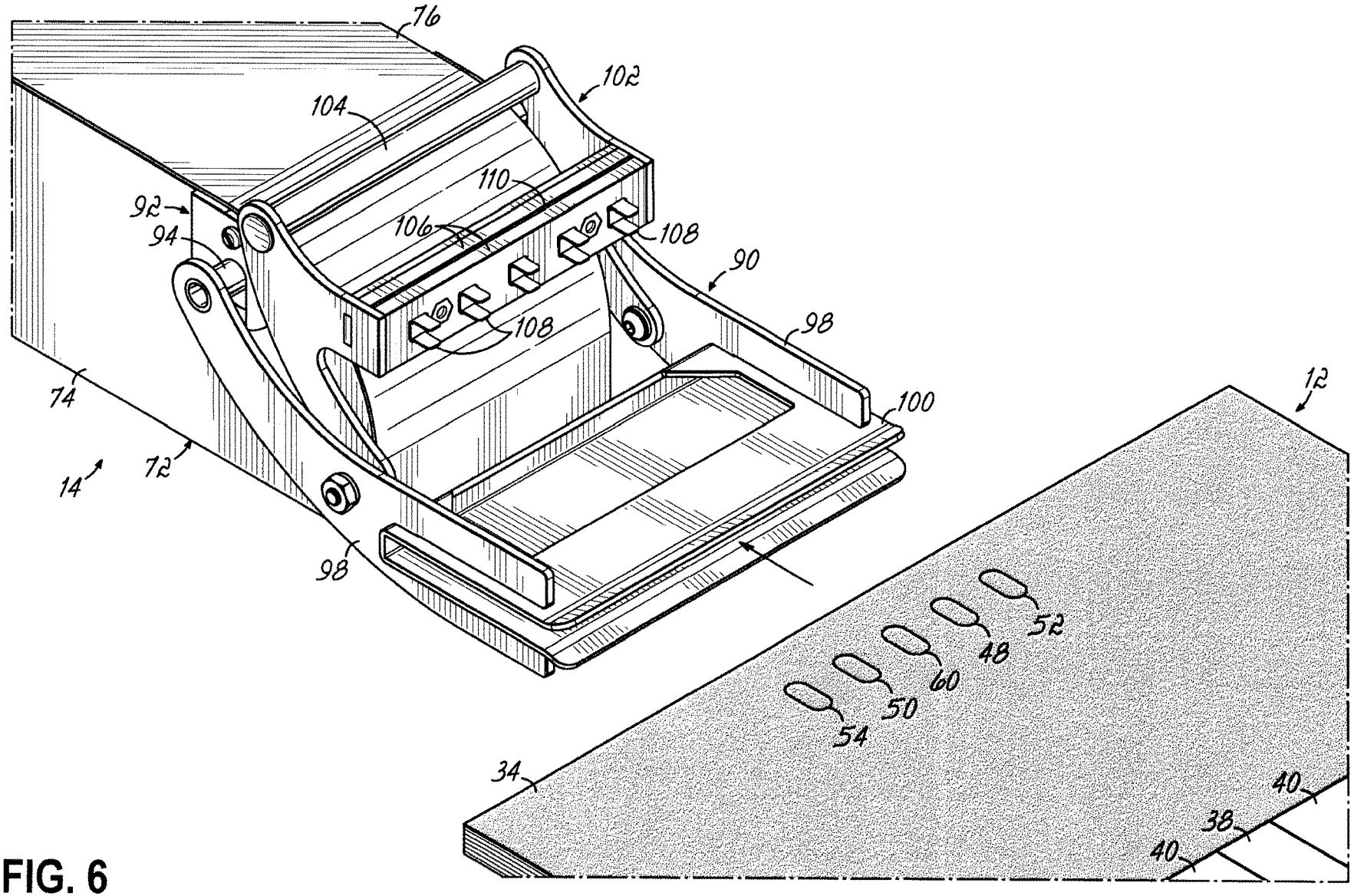
FIG. 6 is a perspective view showing details of the target panel being aligned with a movable arm of the target positioning unit for mounting of the target panel.

Referring to FIG. 6, showing the clamp 102 in an open position, the clamp 102 includes a contact bar 106 that carries a plurality of electrical contact elements shown in the form of dual-pronged electrical contact blades 108. The electrical contact blades 108 are electrically isolated from one another, and are electrically coupled to the controller 84 of the target positioning unit 14. In that regard, the contact bar 106 may include an electrical board 110 that carries electrical conduit tracing to each of the electrical contact blades 108, the electrical conduit also being connected to wiring (not shown) that electrically couples to the controller 84.

Each of the electrical contact blades 108 is configured to be aligned with and pierce a respective one of the electrical connection sites 48, 50, 52, 54, 60 of the target panel 12 when the clamp 102 is pivoted to the closed position. In the illustrated embodiment, the contact bar 106 carries five electrical contact blades 108, corresponding to the five electrical connection sites 48, 50, 52, 54, 60 of the target panel 12. In the illustrated embodiment, the centrally positioned contact blade 108 couples to the single, centrally positioned electrical connection site 60 of the second conductive layer 20 (i.e., the common conductor zone 56), and the remaining contact blades 108 couple to the electrical connection sites 48, 50, 52, 54 of the first conductive layer 18 (i.e., the target zones 38, 40, 42, 44). Various alternative quantities and arrangements of electrical contact blades 108 may be provided to accommodate target panels 12 having alternative quantities and arrangements of target zones and corresponding electrical connection sites.

Figure 7:
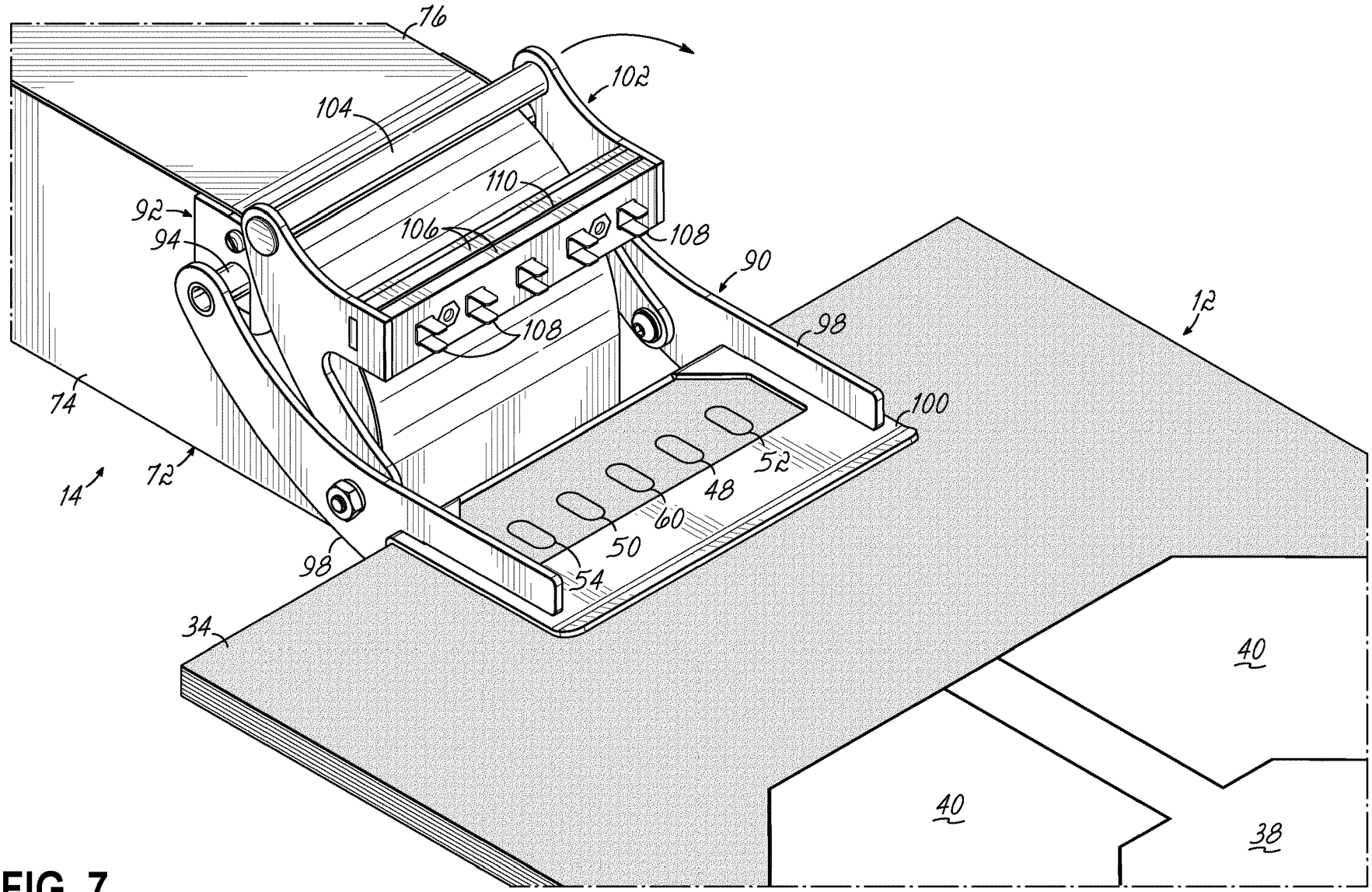
FIG. 7 is a perspective view showing the target panel received within the movable arm, and with a clamp in an open position.
Figure 8:
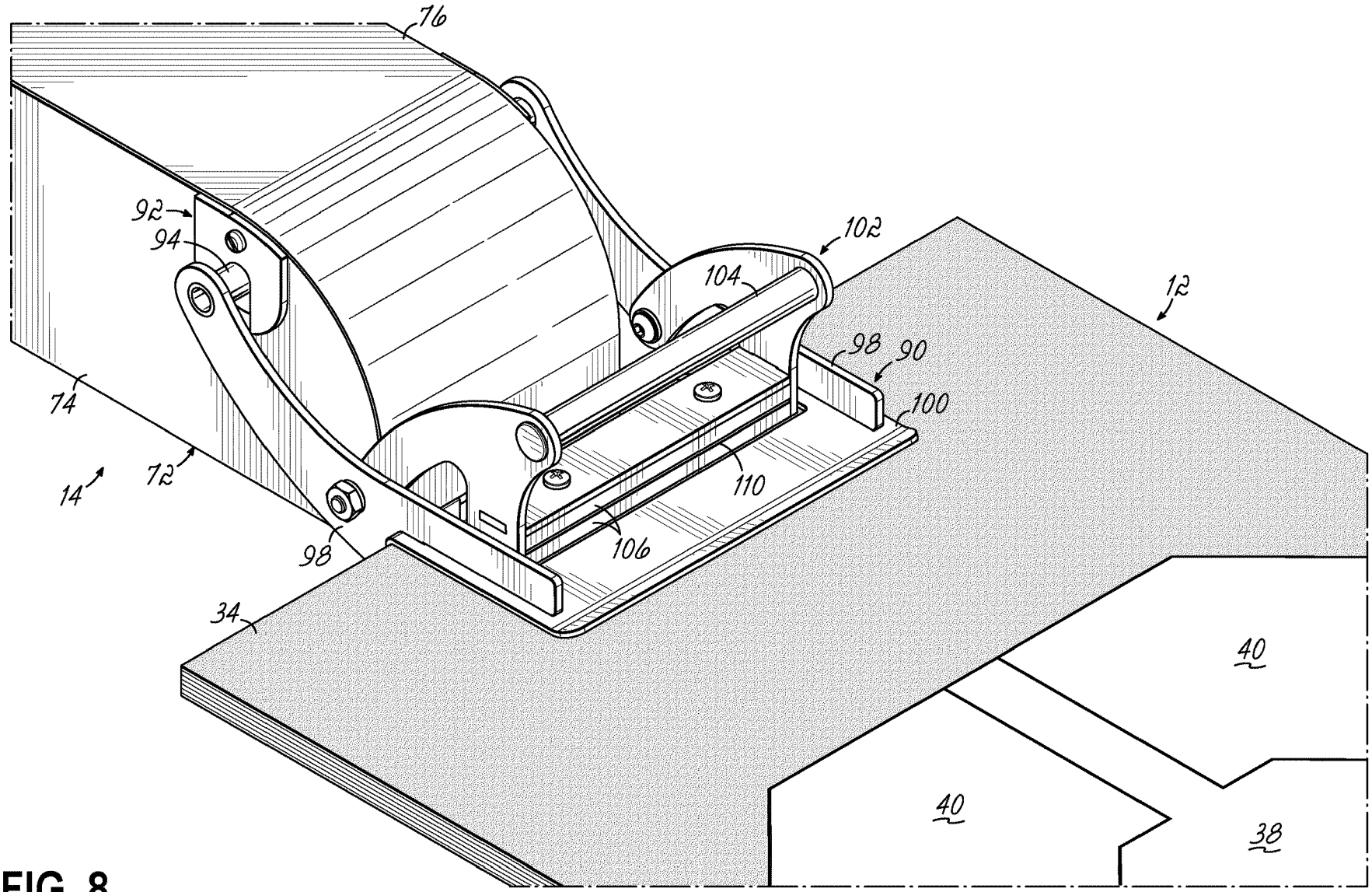
FIG. 8 is a perspective view similar to FIG. 7, showing the clamp in a closed position.

As shown in FIG. 7, the target panel 12 is seated within the channel member 100 so that the electrical connection sites 48, 50, 52, 54, 60, as indicated by the indicia 34, are aligned with the electrical contact blades 108 of the clamp 102. The clamp 102 is then pivoted to the closed position, shown in FIGS. 8 and 9, in which the electrical contact blades 108 pierce through the target panel 12 at the respective electrical connection sites 48, 50, 52, 54, 60. In the closed position, the clamp 102 may exert a slight compressive force on the target panel 12 to retain the target panel 12 within the channel member 100. The first paper reinforcement layer 24 of the target panel 12, described above, provides the target panel 12 with increased rigidity in the lower portion of the target panel 12, including the mounting region that is engaged by the clamp 102 and channel member 100. Thus, the target panel 12 is advantageously provided with a rigid and durable construction that may suitably withstand being moved, by the arm assembly 90, between first and second positions up to multiple hundreds of times, or more.

As shown in FIGS. 10 and 11, when the clamp 102 engages the target panel 12 in the closed position, each electrical contact blade 108 pierces through a front side of the target panel 12 and advances through the individual layers of the target panel 12, including the first and second electrically conductive layers 18, 20. The electrical contact blades 108 may extend substantially fully through the thickness of the target panel 12 and confront a rear portion of the channel member 100.

Figure 9:
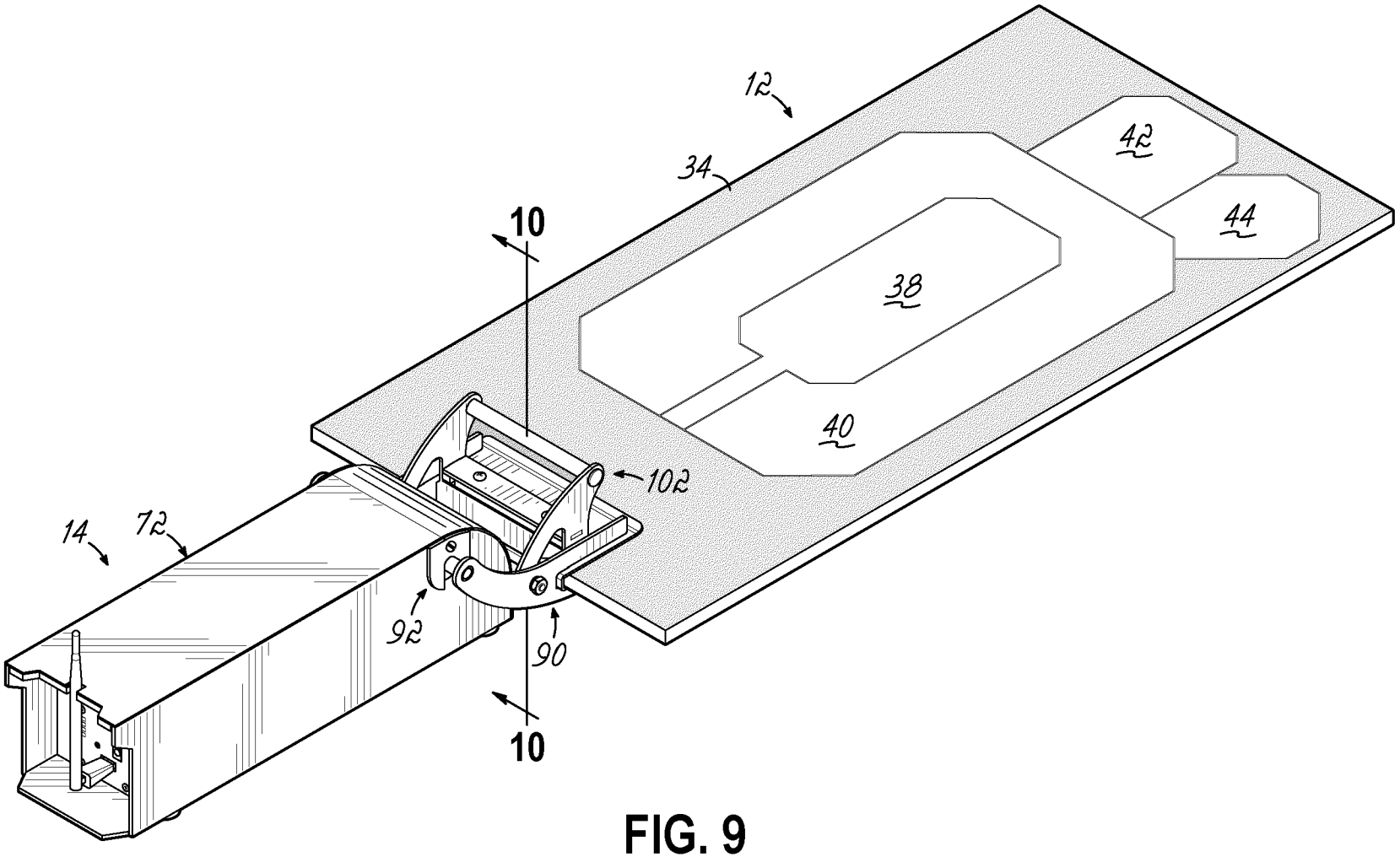
FIG. 9 is a perspective view showing the target panel being supported in an exemplary retracted position by the target positioning unit.

As indicated by section line 10-10 in FIG. 9, FIGS. 10 and 11 illustrate an exemplary piercing site at which a corresponding electrical contact blade 108 engages electrical connection site 54 of the first electrically conductive layer 18, and corresponding dead zone region 70 of the second electrically conductive layer 20. As described above, this configuration prevents a standing electrical coupling of the corresponding target zone 44 of the first conductive layer 18 to the common conductor zone 56 of the second conductive layer 20. Further, in the exemplary embodiment shown in FIGS. 10 and 11, the illustrated dead zone region 70 is made completely devoid of conductive material, and the resulting open space is filled with non-conductive adhesive 36 during construction of the target panel 12.

Once the target panel 12 has been mounted to the arm assembly 90 via the clamp 102, as generally described above, the target zones 38, 40, 42, 44 and the common conductor zone 56 are electrically coupled to the electrical circuit of the target positioning unit 14, including the controller 84 and battery. The battery directs a low voltage electrical current (e.g., 12 volts DC), via the clamp 102 and electrical contact blades 108, to the common conductor zone 56. When a conductive projectile pierces the target panel 12 at a particular target zone 38, 40, 42, 44, as shown in FIG. 2C, the projectile momentarily contacts the first and second electrically conductive layers 18, 20. As a result, the electrical current is enabled to flow through the projectile to complete an electrical circuit formed between the common conductor zone 56 and the impacted target zone 38, 40, 42, 44. As described below, the controller 84 detects this flow of electrical current and identifies the corresponding target zone 38, 40, 42, 44 as having been impacted.

In addition to detecting projectile impacts, the controller 84 also controls the multi-valve solenoid system 86 to actuate the pneumatic cylinder 82 and move the target panel 12, via the pivot lever 96 and the arm assembly 90 between first and second positions. The exemplary first and second positions are shown herein in the form of deployed and retracted positions. As described below, the controller 84 may control the solenoid system 86 and pneumatic cylinder 82, or other actuator system, in response to a manual command transmitted by a user, or in response to an automated command issued as part of a pre-programmed scenario.

An exemplary deployed (or "lifted") position of the target panel 12 is shown in FIG. 4, and an exemplary retracted (or "lowered") position of the target panel 12 is shown in FIG. 9. In the deployed position the target panel 12 is presented to the shooter for targeting, and in the retracted position the target panel 12 is substantially removed from the shooters line of fire, though may still be visible to the shooter. While the deployed and retracted positions shown herein correspond to generally vertical and horizontal orientations, respectively, of the target panel 12, it will be appreciated that in alternative embodiments the deployed and retracted positions may yield various alternative orientations of the target panel 12. Further, rather than deployed and retracted positions, the first and second positions enacted by the targeting positioning unit 14 may be in the form of first and second deployed positions, for example.

Referring back to FIGS. 1 and 5, the pneumatic cylinder 82 of the target positioning unit 14 is powered by a source 112 of compressed gas, such as $CO_2$, air, or Nitrogen, for example. The gas is directed by the multi-valve solenoid system 86. The gas source 112 may be in the form of a pressurized gas tank, for example, of any suitable volume. Further, the gas source 112 may be located remotely from the target positioning unit 14, as shown schematically in FIG. 1, so as to protect the gas source 112 from accidental damage by fired projectiles. In embodiments in which the target system 10 includes multiple target positioning units 14, each of the positioning units 14 may be powered by a single compressed gas tank. The multiple positioning units 14 may be connected in series (i.e., "daisy chain"), or in parallel, for example. In an exemplary embodiment, up to twelve target positioning units 14 may be powered by a single compressed gas tank.

Each target positioning unit 14 may include a gas regulator (not shown) for adjusting a pressure of compressed gas delivered to the multi-valve solenoid system 86 from the gas source 112. In exemplary embodiments, the gas regulator may be set to deliver gas at a pressure of 60 psi, for example. The multi-valve solenoid system 86 may include first and second solenoids for directing the compressed gas to and from the pneumatic cylinder 82. The first solenoid may direct the compressed gas to fill the pneumatic cylinder 82 for moving the arm assembly 90 and target panel 12 to a first deployed position, for example as shown in FIG. 4. The second solenoid (or "dump valve") may vent compressed gas from the pneumatic cylinder 82 to move the arm assembly 90 and target panel 12 to a second retracted position, for example as shown in FIG. 9. The second solenoid may be connected to an exhaust of the first solenoid, which may vent the pneumatic cylinder 82 to the second solenoid so as to provide a latching effect. In exemplary embodiments, the controller 84 may control the solenoid system 86 to rapidly vent and fill the pneumatic cylinder 82 to "flinch" or "wiggle" the target panel 12, and thereby provide a visual indication to the shooter that a particular event has occurred, for example that the target panel 12 has been impacted by a projectile at a particular target zone 38, 40, 42, 44.

Figure 12A:
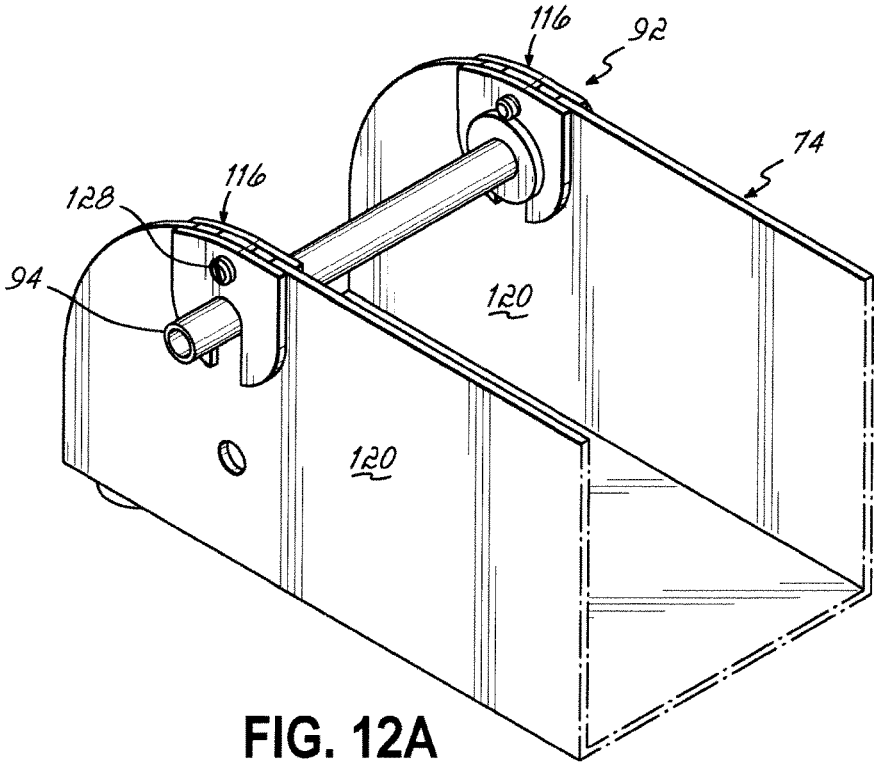
FIG. 12A is a perspective view showing details of a pivot assembly of the target positioning unit.
Figure 12B:
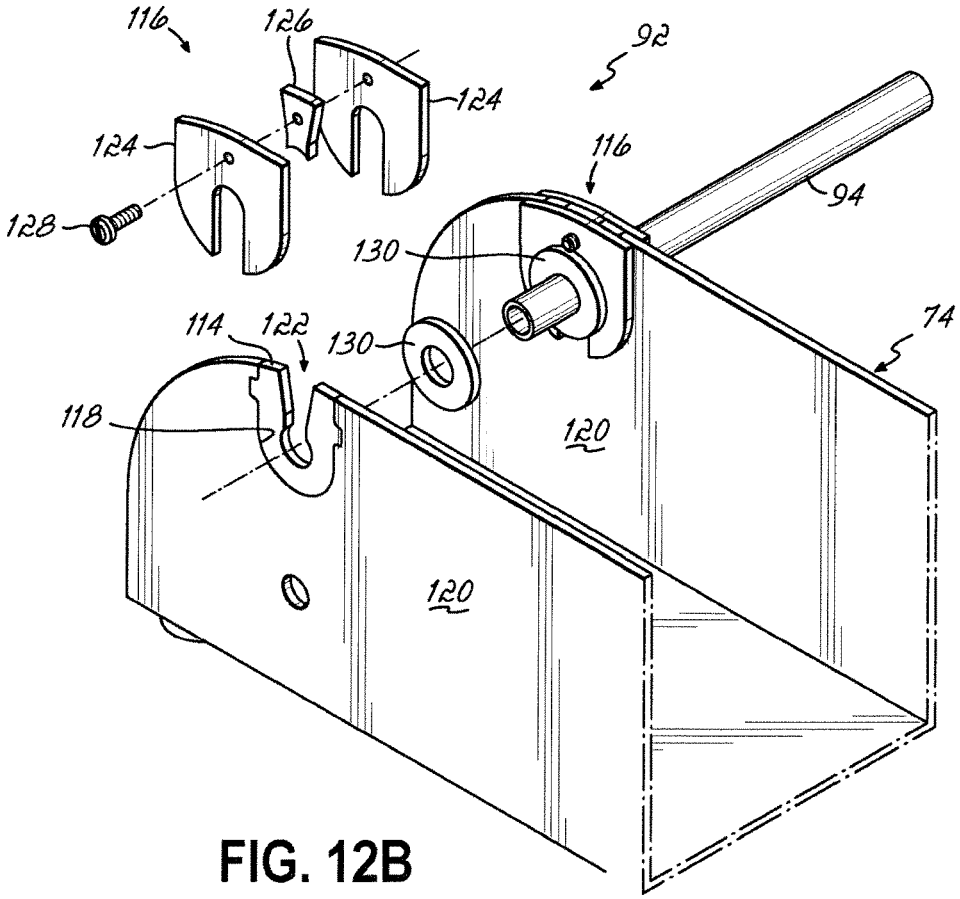
FIG. 12B is an exploded perspective view of the pivot assembly of FIG. 12A.

Referring to FIGS. 12A and 12B, additional details of the pivot assembly 92 of the target positioning unit 14 are shown. The pivot assembly 92 includes the pivot axle 94, a pair of bearing inserts 114, and a pair of retainer saddles 116. The bearing inserts 114 are received within generally U-shaped cutouts 118 formed in upper edges of sidewalls 120 of the lower body 74 of the target positioning unit housing 72. The pivot axle 94 is received and rotatable within generally U-shaped bight openings 122 of the bearing inserts 114.

A retainer saddle 116 is positioned atop the pivot axle 94 at each housing side wall 120, and assists in retaining the pivot axle 94 in engagement with the bearing inserts 114 by restraining the pivot axle 94 in its radial direction. Each retainer saddle 116 includes a pair of plates 124 each having a U-shaped slot, and an upper bearing spacer 126 arranged between the plates 124. The plates 124 and upper bearing spacer 126 of each retainer saddle 116 are clamped together with a fastener 128, and each assembled retainer saddle 116 is snapped into engagement with the respective bearing insert 114 to thereby secure the pivot axle 94 in place. Movement of the pivot axle 94 along its longitudinal axis relative to the retainer saddles 116 and bearing inserts 114 may be restrained by disc elements 130 positioned along the pivot axle 94 adjacent to the retainer saddles 116. The pivot assembly 92 is easily disassembled by a user with little or no tools for maintenance or replacement of components in the field as needed. Further, the bearing inserts 114 and retainer saddles 116 may be formed of plastic material so as to minimize replacement costs incurred by users.

System Communications

Figure 13:
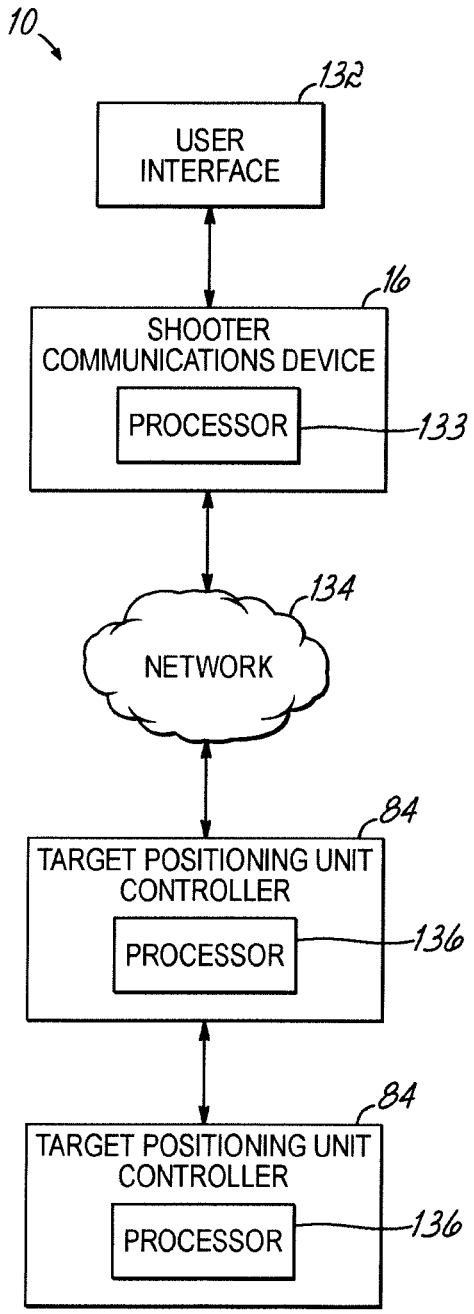
FIG. 13 is a diagrammatic view of exemplary communication elements of the target system of FIG. 1.

Referring to FIG. 13, a diagrammatic view of the control and communication elements of a target system 10 having first and second target panels 12 and corresponding first and second target positioning units 14, is shown. The control and communication elements of the target system 10 include a shooter communications device 16 having a user interface 132 and a processor 133, a network 134, and first and second target positioning unit controllers 84 each having a processor 136. The shooter communications device 16 may include software, firmware, hardware, or any combination thereof. Software may include one or more applications on an operating system. Hardware may include, but is not limited to, a processor, memory, and/or a graphical user interface display.

A shooter or other user of the target system 10 may interact with the shooter communications device 16 via the user interface 132. The user interface 132 may include any type of display device including but not limited to a touch screen display, a cathode ray tube (CRT) monitor, a liquid crystal display (LCD) screen, and/or any other type of display device that includes a display that will be apparent to those skilled in the art of the present invention. The shooter communications device 16 may be any device that is capable of electronically communicating with other devices. Examples of the shooter communications device 16 may include a mobile telephone, a smartphone, a portable computing device such as a laptop or tablet computer, other computing devices such as a desktop computer, or any cluster of computing devices, for example.

The shooter communications device 16 communicates with the controllers 84 of the target positioning units 14 via the network 134. The network 134 may include one or more networks, such as the Internet, and may include one or more wide area networks (WAN) or local area networks (LAN). While the exemplary embodiment disclosed herein implements the network 134 in the form of a wireless LAN (or "Wi-Fi"), the network 134 may alternatively be in the form of a wired LAN. In that regard, the network 134 may utilize one or more network technologies such as Ethernet, Fast Ethernet, Gigabit Ethernet, virtual private network (VPN), remote VPN access, or a variant of IEEE 802.11, for example. Communication over the network 134 takes place using one or more network communication protocols, including reliable streaming protocols such as transmission control protocol (TCP). It will be understood that these examples are merely illustrative and not intended to limit the present invention.

As described above, each target positioning unit 14 may include a wireless communications module 88, such as a Wi-Fi adapter, coupled to the unit controller 84 for communicating signals over the network 134. Moreover, each target positioning unit 14 may function as a "repeater" for relaying signals between the shooter communications device 16 and one or more other target positioning units 14 of the target system 10. For example, a first target positioning unit 14 located within the wireless operating range of the shooter communications device 16 may relay signals received from the shooter communications device 16 to a second target positioning unit 14 located beyond the wireless operating range. Similarly, the first target positioning unit 14 may relay signals received from the second target positioning unit 14 back to the shooter communications device 16. In an exemplary embodiment, the target positioning units 14 may be positioned up to 250 yards from one another, while maintaining their ability to communicate with one another via their wireless communications modules 88. In another embodiment, the target system 10 may further include a directional, extended-range Wi-Fi adapter (not shown) that increases the wireless operating range between the shooter communications device 16 and a first target positioning unit 14 of the target system 10.

The Shooter Communications Device

Figure 14:
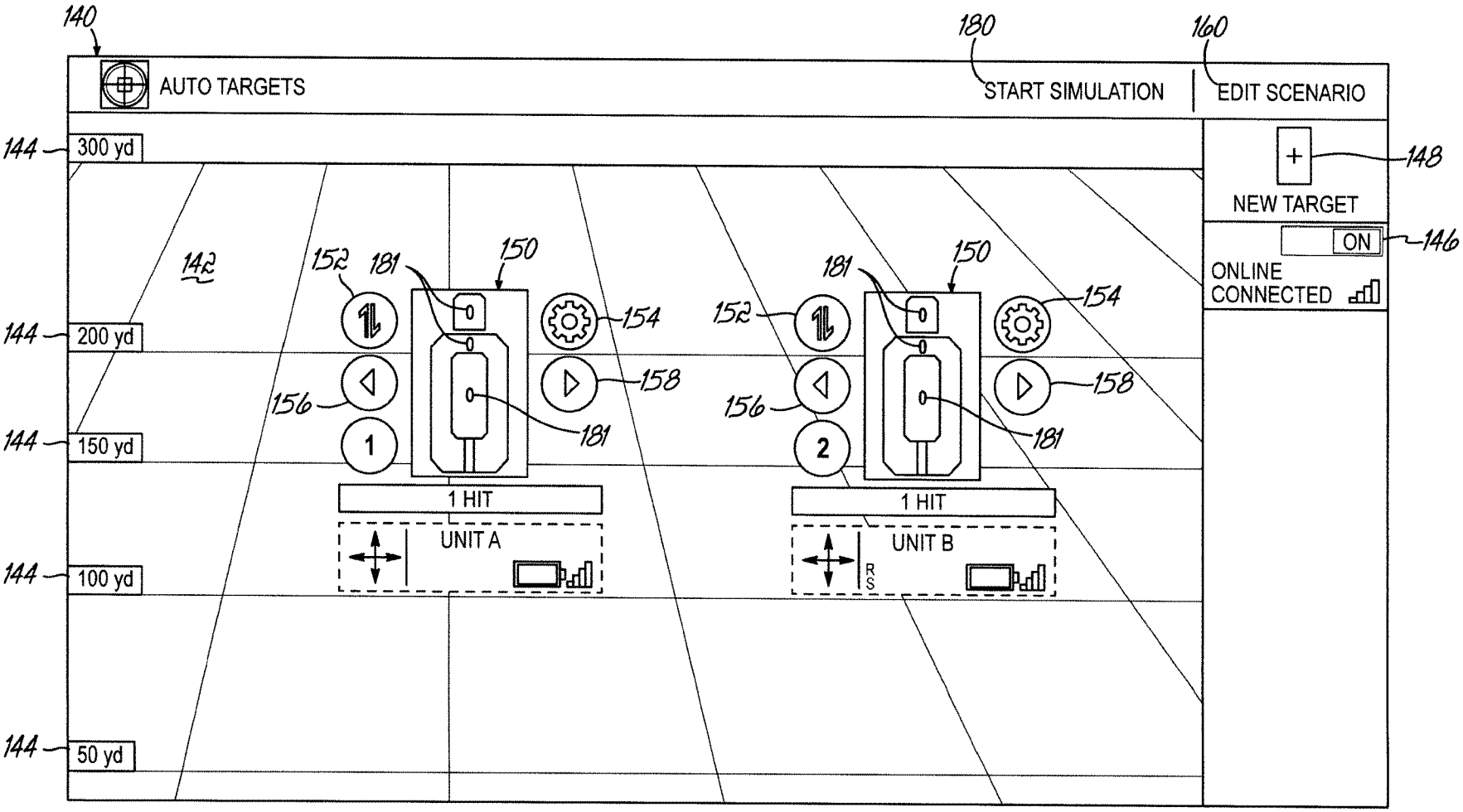
FIG. 14 is a first exemplary view of a display on a shooter communications device of the target system of FIG. 1.
Figure 15:
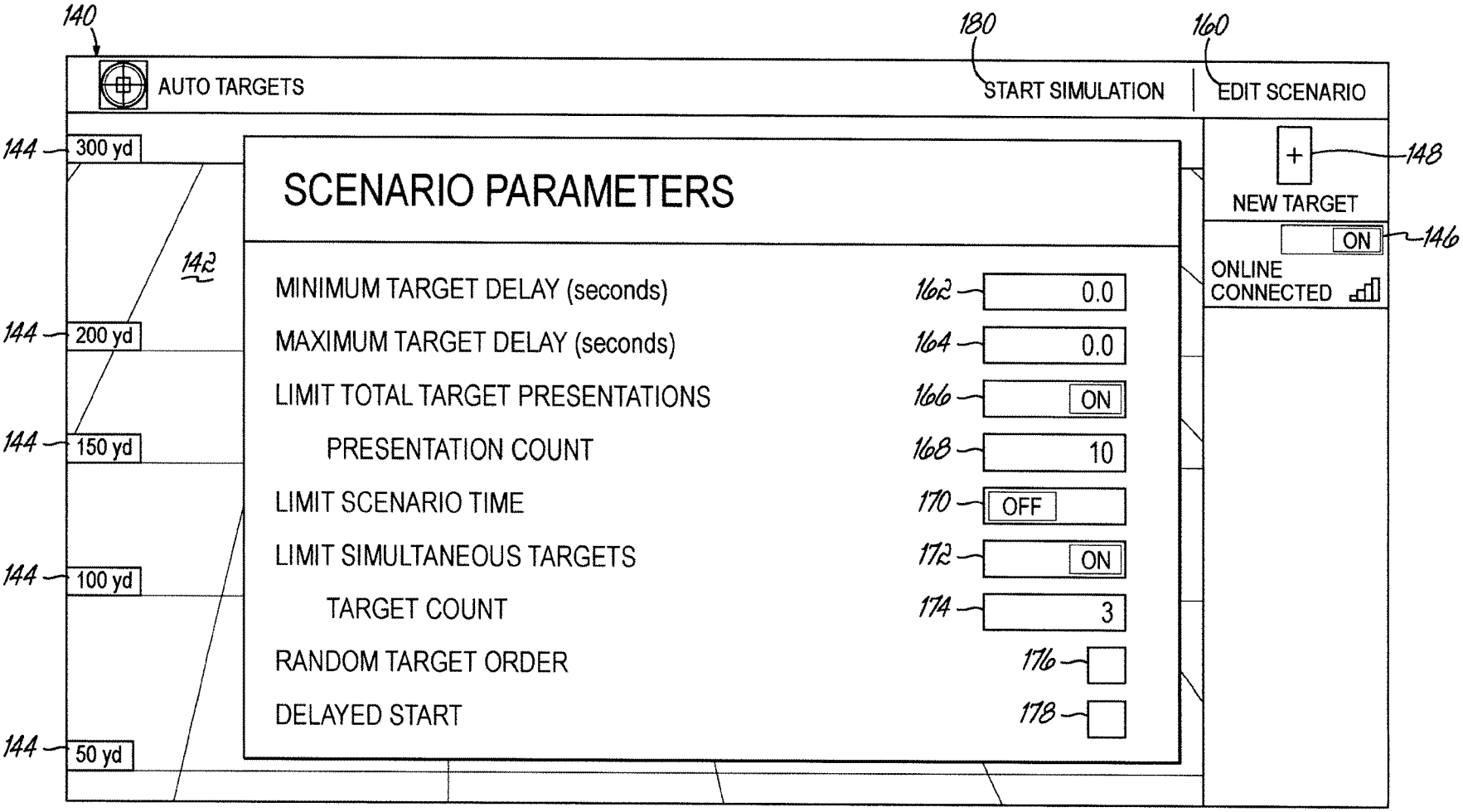
FIG. 15 is a second exemplary view of the display of the shooter communications device.
Figure 16:
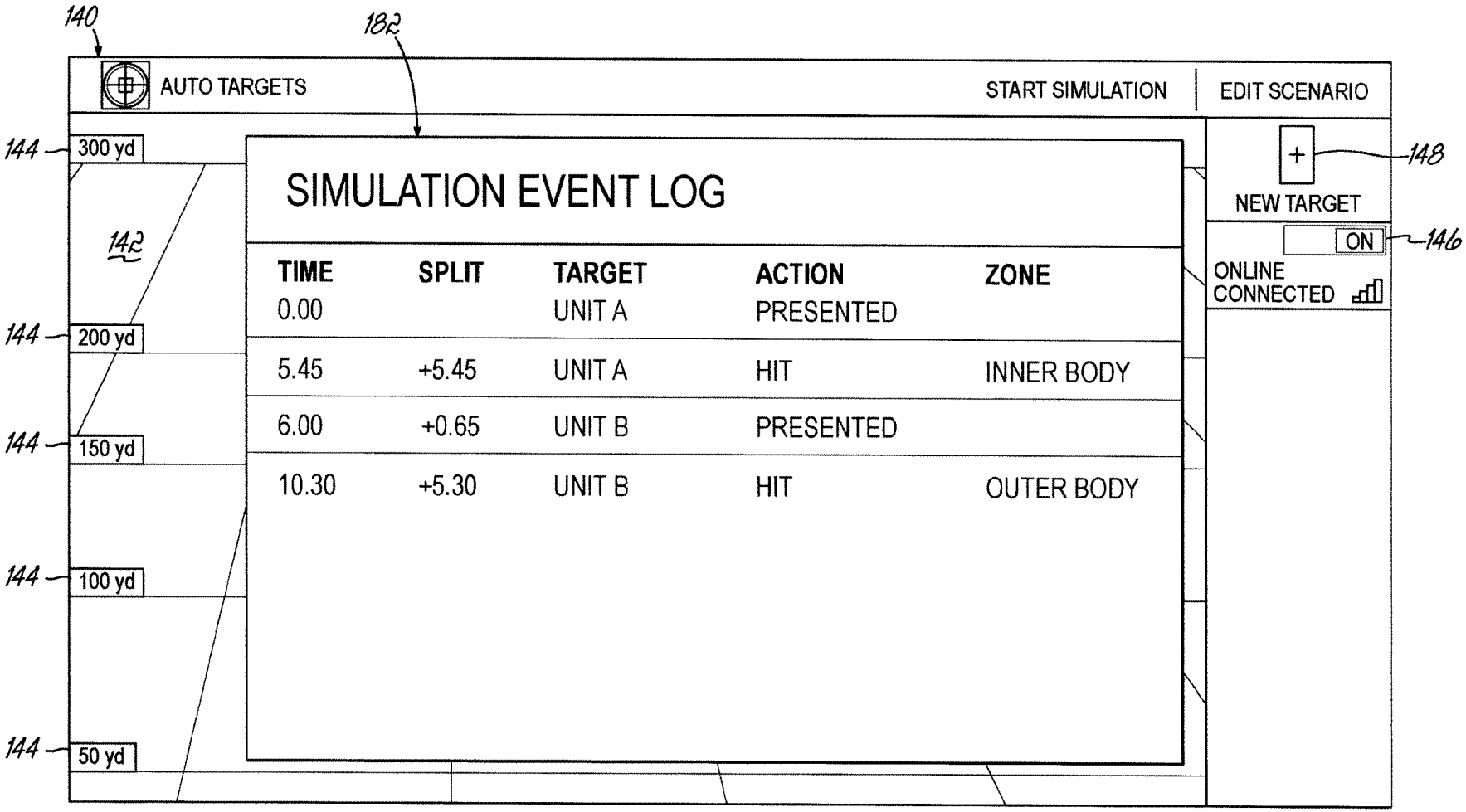
FIG. 16 is a third exemplary view of the display of the shooter communications device.

Referring to FIGS. 14-16, aspects of the shooter communications device 16 according to an exemplary embodiment are shown in greater detail. The shooter communications device 16, which may be in the form of a smartphone or tablet computer, for example, runs a software application that allows the shooter to control and receive information, via a wireless network, about various aspects of one or more target panels 12 and corresponding target positioning units 14 of the target system 10. Before initiating control parameters of the software application, as described below, the target positioning units 14 are first positioned as desired on a target range, and are powered on.

As shown in FIG. 14, an exemplary display 140 of the shooter communications device 16 displays a virtual landscape 142, on which virtual representations of the target panels 12 of the target system 10 may be positioned. The virtual landscape 142 may include range measurements 144 that indicate distance from a line of fire. While the exemplary virtual landscape 142 shown in FIG. 14 depicts a simple field-type shooting range, the virtual landscape 142 may depict any alternative shooting environment desired. For example, in one embodiment the virtual landscape 142 may depict a shoot house facility, such as the exemplary shoot house facility 190 described below. Further, while the virtual landscape 142 of FIG. 14 is depicted on the display 140 in perspective view, it will be appreciated that the virtual landscape 142 may be depicted in any suitable alternative view, such as a top-down view, for example.

Wireless communication abilities (e.g., Wi-Fi) of the shooter communications device 16 may first be activated by selecting an ON button 146 shown on the display 140. Once the wireless communication is activated, the display 140 shows a target identification element (not shown) assigned to each of the powered target positioning units 14 detected, via the network 134, within wireless range of the shooter communications device 16. The user may then select a NEW TARGET button 148, which creates a virtual target element 150 that the user may drag onto the virtual landscape 142 to a position that corresponds to the location of a powered target positioning unit 14. This process may be repeated for each of the powered target positioning units 14 detected. The user may then link each of the virtual target elements 150 shown on the display 140 with a target identification element and its corresponding target positioning unit 14.

Each virtual target element 150 includes a target positioning button 152, which may be selected to control the corresponding target positioning unit 14 to move its target panel 12 between first and second positions, such as a deployed position and a retracted position. Each virtual target element 150 also includes a presentation time button 154, which may be selected to specify a maximum time duration for which the target panel 12 is presented to the shooter for completion of a target scenario as described below.

Each virtual target element 150 also includes left and right selector buttons 156, 158, which may be selected by the user to cycle through a series of pre-programmed target scenarios. Each target scenario specifies target hit criteria that must be satisfied with respect to a linked target panel 12 in order for the target scenario to be deemed complete. The target hit criteria may specify one or more of the linked target zones 38, 40, 42, 44 that must be hit one or more times by fired projectiles in order for the target scenario to be deemed complete. In one embodiment, the target scenario may specify that the target panel 12 must only be hit once at any of the target zones 38, 40, 42, 44. In another embodiment, the target scenario may be set to an "Unlimited Hits" option, in which the target scenario has no predetermined completion criteria and thus allows the target panel 12 to be hit an unlimited number of times. As described below, in response to identifying completion of a target scenario for a particular target panel 12, the shooter communications device 16 may instruct the corresponding target positioning unit 14 to reposition the target panel 12, for example from a deployed position to a retracted position. Alternatively, the target panel 12 may be held stationary in its deployed position, and completion of the target scenario may be communicated to the shooter by visible and/or audible signals emitted by the visual/audio indicating mechanism 89, described above.

Referring to FIG. 15, the user may select an EDIT SCENARIO button 160 on the display 140 to create a complex shooting scenario that involves one or more, for example two, target positioning units 14 and corresponding target panels 12 of the target system 10. As shown, the user may adjust parameters of the complex shooting scenario, including: a minimum time delay on the presentation of a target panel 12 (indicated at 162); a maximum time delay on the presentation of a target panel 12 (indicated at 164); a total number of times the target panels 12 are presented (indicated at 166, 168); a time limit on the shooting scenario (indicated at 170); a limit on the number of target panels 12 that may be presented simultaneously (indicated at 172, 174); an option to randomize the order in which the target panels 12 are presented (indicated at 176); and an option to delay the start of the shooting scenario (indicated at 178), for example.

In an exemplary embodiment, the shooter may create a complex shooting scenario in which three random target panels 12 are presented at all times; for example, a target panel 12 may be retracted upon being shot once, and thereafter another target panel 12 is deployed so that three target panels 12 remain standing at all times. To establish this exemplary shooting scenario on the display 140, the shooter would set Limit Total Target Presentations 166 to "ON," set Presentation Count 168 to "10," set Limit Simultaneous Targets 172 to "ON," set Target Count 174 to "3," and set Minimum Target Delay 162 and Maximum Target Delay 164 each to "0".

To activate tracking of shooting performance, as well as initiate any complex shooting scenario created as described above, the user selects a START SIMULATION button 180 on the display 140, and thereafter engages in shooting activity. During shooting activity, when the controller 84 of the target positioning unit 14 detects a projectile impact of a target zone 38, 40, 42, 44 of a target panel 12, the controller 84 identifies the target zone 38, 40, 42, 44 as an impacted target zone, and generates a corresponding electrical signal. The controller 84 then transmits the signal, for example via the wireless communications module 88, to the shooter communications device 16. The shooter communications device 16 then displays a visual indication of the projectile impact on the corresponding virtual target element 150 shown on the display 140. For example, as shown in FIG. 14, each target zone of a virtual target element 150 may display a numeral 181 corresponding to the number of times that a target zone 38, 40, 42, 44 has been impacted by projectiles. In alternative embodiments, the shooter communications device 16 and/or the target positioning unit 14 itself (via the visual/audio indicating mechanism 89) may provide to the shooter various other types of visual, audible, or tactile indications in response to projectile impact detection. In this manner, the shooter communications device 16 tracks and communicates, in real time, shooting performance with respect to each of the target panels 12, individually.

Upon identifying successful completion of a target scenario as described above, the shooter communications device 16 may send an instruction signal to the controller 84 of the corresponding target positioning unit 14 to provide an indication to the shooter that the target scenario has been completed. In one embodiment, this indication may be provided in the form of a physical repositioning, by the arm assembly 90, of the target panel 12 from a first position (e.g., a deployed position) to a second position (e.g., a retracted position). This repositioning of the target panel 12 may be visually apparent to the shooter so as to provide a clear indication of target scenario completion, without requiring the shooter to consult the shooter communications device 16. Alternatively, or in addition to the physical repositioning of the target panel 12, the indication of target scenario completion may be provided in the form of lighting and/or sound effects emitted from the visual/audio indicating mechanism 89, described above. In one embodiment, the indication of target scenario completion may be provided by the visual/audio indicating mechanism 89 while the target panel 12 is held stationary in its original position.

As described above, a first target positioning unit 14 may function to relay signals to a second target positioning unit 14 located beyond a wireless operating range of the shooter communications device 16. Accordingly, signals pertaining to a target scenario associated with a second, out-of-range target positioning unit 14 may be communicated back and forth to the shooter communications device 16 via the first target positioning unit 14.

Referring to FIG. 16, at anytime during shooting activity the user may pause or stop the simulation and review shooting performance on a Simulation Event Log 182. The Simulation Event Log 182 may display a timeline that identifies specific times at which target panels 12 were presented and hit, if at all. The Log 182 may also the specific target zones 38, 40, 42, 44 that were hit, such as inner body target zone 38 or outer body target zone 40, for example, as shown.

External Trigger Applications

Figure 17:
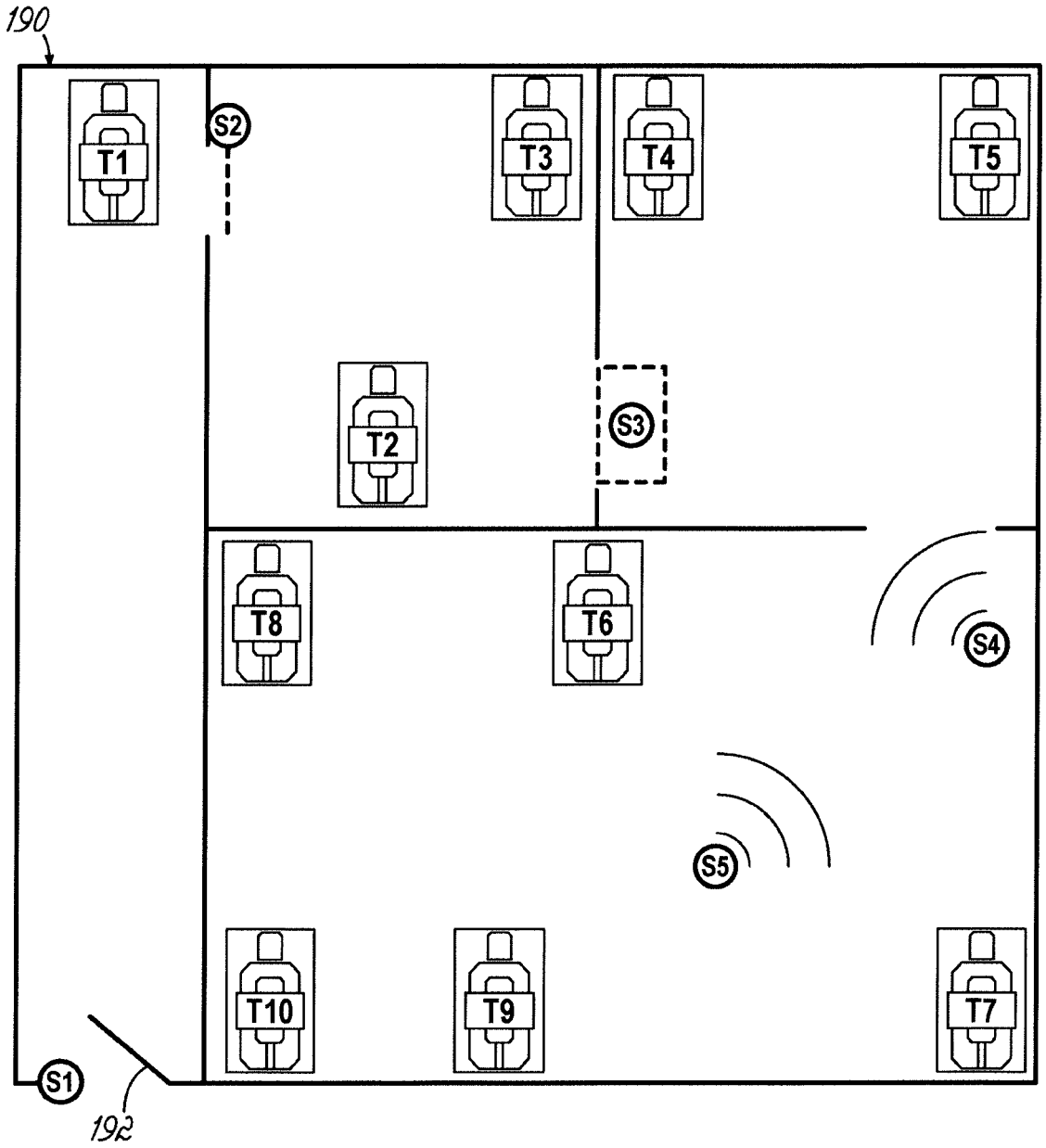
FIG. 17 is a schematic view of an exemplary external trigger application of the target system of FIG. 1.
Figure 18:
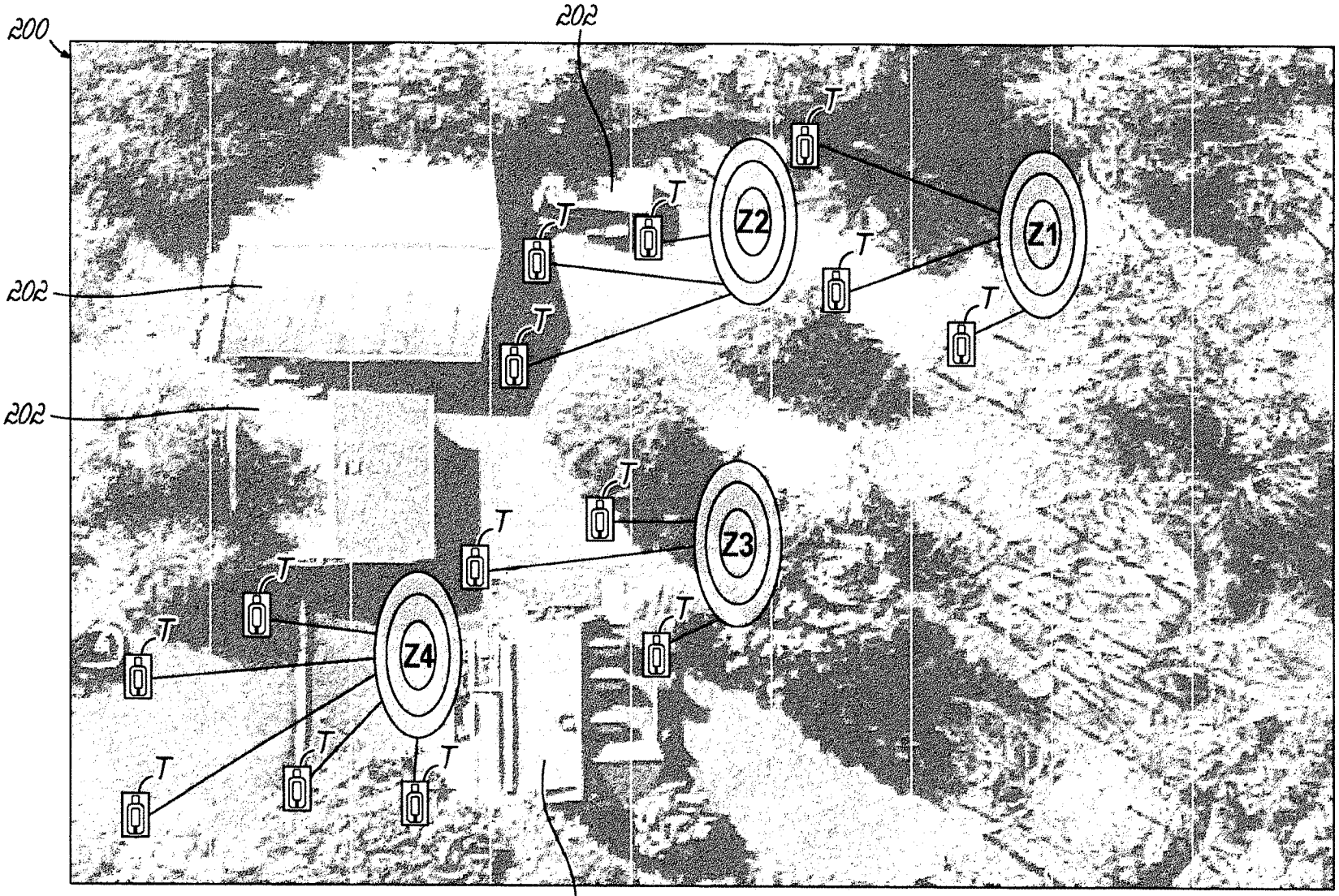
FIG. 18 is a schematic view of another exemplary external trigger application of the target system of FIG. 1.

Referring to FIGS. 17 and 18, the target system 10 may be implemented with one or more programmable external trigger devices that trigger deployment of one or more target panels 12. As described above, each target positioning unit 14 includes an external trigger port 80 configured to couple the target positioning unit controller 84 to an external trigger device. When the external trigger device is activated it sends a signal to the controller 84, which may then determine that the target panel 12 should be deployed. The external trigger device may be located remotely from the target positioning unit 14, and may be in the form of a switch, a timer, or various types of sensors that interact with a local environment, including optical sensors, pressure sensors, motion sensors, thermal sensors, and the like, for example. In another embodiment, the external trigger device may be in the form of a global positioning system ("GPS") device that tracks the position of a shooter relative to one or more target positioning units 14.

Referring to FIG. 17, a first exemplary external trigger application of the target system 10 is shown. A plurality of target positioning units 14 and target panels 12 (referred to below, in combination, as "target units") are shown positioned throughout rooms of an exemplary shoot house facility 190, for which bold lines shown represent room walls. Each target unit is linked to an external trigger device. A first external trigger device is shown in the form of a switch S1 mounted to a door 192, and triggers a first target unit T1 to deploy when the door 192 is opened. A second external trigger device is shown in the form of an optical (e.g., laser) tripwire S2 that triggers second and third target units T2, T3 to deploy when the tripwire S2 is set off. A third external trigger device is shown in the form of a pressure pad S3 that triggers a fourth target unit T4 to deploy when a shooter steps on the pressure pad S3. Upon completion of a target scenario assigned to the fourth target unit T4, a fifth target unit T5 automatically deploys.

A fourth external trigger device is shown in the form of a first motion detector S4 that triggers a sixth target unit T6 to deploy in response to detecting motion of the shooter. A seventh target unit T7 is linked to a timer and automatically deploys two seconds, for example, after the sixth target unit T6. A fifth external trigger device is shown in the form of a second motion detector S5 that triggers an eighth target unit T8 to deploy in response to detecting a motion of the shooter when entering the room. A ninth target unit T9 automatically deploys upon completion of a target scenario assigned to the eighth target unit T8. Similarly, a tenth target unit T10 automatically deploys upon completion of a target scenario assigned to the ninth target unit T9. In response to detecting a motion of the shooter when leaving the room, the second motion detector S5 may trigger the tenth target unit T10 to redeploy.

It will be appreciated that the specific layout of the shoot house facility 190, the quantity and arrangement of target units T1-T10, and the form and placement of the external trigger devices S1-S5 shown are for illustrative purposes only, and are merely one example of an external trigger application of the target system 10.

Referring to FIG. 18, another exemplary external trigger application of the target system 10 is shown. A plurality of target units T are arranged on a shooting compound 200 around various structures, shown in the form of buildings 202. The target units T may be arranged into target unit groups, each target unit T of a group being linked to a respective GPS trigger zone Z1, Z2, Z3, Z4. For example, each of the target units T of a target unit group may include a GPS communications device (not shown) that is linked to or otherwise identifies the respective GPS trigger zone Z1, Z2, Z3, Z4. Alternatively, each of the target units T of a target unit group may communicate with a common GPS communications device that is linked to or otherwise identifies the respective GPS trigger zone Z1, Z2, Z3, Z4.

The shooter may carry a separate GPS communications device that communicates wirelessly with the GPS communications devices assigned to the target units T. Accordingly, when the shooter enters a particular GPS trigger zone Z1, Z2, Z3, Z4, one or more of the target units T of the respective target unit group may be deployed. In exemplary embodiments, the target units T of each target unit group may be controlled such that, following entry of the shooter into the respective GPS trigger zone Z1, Z2, Z3, Z4, the target units T are deployed in a pre-determined sequence, or in response to completion of a target scenario assigned to an earlier-deployed target unit T of the target unit group.

In other exemplary embodiments not illustrated herein, the target system 10 may further include one or more mobile vehicles, such as land rovers for example, on which respective target positioning units 14 are mounted. In one embodiment, the target positioning unit 14 may be formed integrally with the structure of the mobile vehicle. The mobile vehicles may be operated remotely or autonomously to travel along desired paths in a shooting compound so as to provide an interactive shooting experience for a shooter. In exemplary embodiments, each target positioning unit 14 and/or its corresponding mobile vehicle may be equipped with an external trigger device, such as the exemplary devices described above, for example, that interact with the shooter to facilitate strategic deployment of the target panels 12.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. A target system for sensing impacts of a target panel by projectiles fired by a shooter, the target system comprising;

at least one target panel having one or more target zones;

at least one target positioning unit that moves the at least one target panel between a first position and a second position;

a base of said target positioning unit;

an arm of said target positioning unit, said arm is movably coupled to the base and having a support structure that supports the target panel;

wherein said arm comprises a pair of elongate claws having distal ends supporting an elongate channel member configured for receiving and supporting said at least one target panel after it is seated within said elongate channel member;

wherein said arm further comprises a clamp which is pivoted relative to said pair of elongate claws between an open position and a closed position in which said clamp applies a compressive force on said at least one target panel within said elongate channel member;

wherein said clamp further comprises a contact bar having a plurality of electrical contact elements configured to be aligned with and pierce respective electrical connection sites of said at least one target panel when the clamp is pivoted to the closed position to extend substantially through the thickness of said at least one target panel;

an actuator coupled to the arm and operable to move the arm and the target panel between the first position and the second position; and a controller that controls the actuator and detects a projectile impact of the target panel.

2. The target system of claim 1, wherein in response to detecting the projectile impact the controller controls the actuator to move the target panel from the first position to the second position.

3. The target system of claim 1, wherein in response to detecting the projectile impact the controller generates a signal corresponding to the projectile impact and transmits the signal to a receiving device.

4. The target system of claim 3, wherein the at least one target positioning unit further includes a wired or wireless communication module configured to wirelessly transmit the signal to a receiving device.

5. The target system of claim 1, wherein the target panel includes first and second electrically conductive layers separated by an insulating layer, and the at least one target positioning unit further includes an electrical coupling mechanism that electrically couples the controller to the first electrically conductive layer and separately to the second electrically conductive layer, and wherein the controller detects an electrical current flowing between the first and second electrically conductive layers when the target panel is pierced by a conductive projectile, generates a signal in response to detecting the electrical current, and transmits the signal to a receiving device.

6. The target system of claim 5, wherein the one or more target zones are defined by the first electrically conductive layer, the target panel further including one or more electrical connection sites corresponding respectively to the one or more target zones, and an electrical connection site corresponding to a conductor zone defined by the second electrically conductive layer, wherein the electrical coupling mechanism includes a plurality of electrical contact elements, each electrical contact element configured to electrically couple to a respective one of the electrical connection sites of the first and second electrically conductive layers, and wherein when a projectile pierces one of the one or more target zones of the target panel, the controller detects an electrical current flowing between the first and second electrically conductive layers in the region of the target zone, and in response to detecting the electrical current the controller identifies the target zone as impacted.

7. The target system of claim 6, wherein the electrical contact elements include electrical contact blades arranged on the electrical coupling mechanism so that each electrical contact blade is positioned to pierce a respective one of the electrical connection sites of the first and second electrically conductive layers.

8. The target system of claim 1, wherein the at least one target panel includes a plurality of target panels and the at least one target positioning unit includes a plurality of target positioning units, and each of the target positioning units moves a respective one of the target panels between the first position and the second position.

9. The target system of claim 8, wherein each of the target positioning units further includes a wired or wireless communication module configured to communicate with at least one of the other target positioning units.

10. The target system of claim 1, wherein in response to detecting the projectile impact the controller generates a signal corresponding to the projectile impact, and the at least one target positioning unit further includes a wired or wireless communication module that transmits the signal, the system further comprising:

a shooter communications device that communicates with the controller via the communication module to receive the signal, and in response to receiving the signal the shooter communications device communicates data to the shooter corresponding to the projectile impact.

11. The target system of claim 1, wherein said actuator comprises a pneumatic cylinder powered by a source of compressed gas directed through a multiple valve solenoid system.

12. The target system of claim 11, wherein said pneumatic cylinder is configured for filling and venting compressed gas from said pneumatic cylinder.

13. The target system of claim 12, wherein said pneumatic cylinder is configured for flinching or wiggling said target panel, as well as for moving said target panel between said first and second positions.

14. A target system for sensing impacts of a target panel by projectiles fired by a shooter, the target system comprising;

a target positioning unit configured for receiving at least one target panel and for moving the at least one target panel between a first position and a second position;

a base of said target positioning unit;

an arm of said target positioning unit, wherein said arm is movably coupled to the base and having a support structure that supports the target panel;

wherein said arm comprises a pair of elongate claws having distal ends supporting an elongate channel member configured for receiving and supporting said at least one target panel after it is seated within said elongate channel member;

wherein said arm further comprises a clamp which is pivoted relative to said pair of elongate claws between an open position and a closed position in which said clamp applies a compressive force on said at least one target panel within said elongate channel member;

wherein said clamp further comprises a contact bar having a plurality of electrical contact elements configured to be aligned with and pierce respective electrical connection sites of said at least one target panel when the clamp is pivoted to the closed position to extend substantially through the thickness of said at least one target panel;

an actuator coupled to the arm and operable to move the arm and the target panel between the first position and the second position; and a controller that controls the actuator and detects a projectile impact of the target panel.

15. The target system of claim 14, wherein in response to detecting the projectile impact the controller controls the actuator to move the target panel from the first position to the second position.

16. The target system of claim 14, wherein in response to detecting the projectile impact the controller generates a signal corresponding to the projectile impact and transmits the signal to a receiving device.

17. The target system of claim 14, wherein the at least one target positioning unit further includes a wired or wireless communication module configured to wirelessly transmit the signal to a receiving device.

18. The target system of claim 14, wherein the target panel includes first and second electrically conductive layers separated by an insulating layer, and the at least one target positioning unit further includes an electrical coupling mechanism that electrically couples the controller to the first electrically conductive layer and separately to the second electrically conductive layer, and wherein the controller detects an electrical current flowing between the first and second electrically conductive layers when the target panel is pierced by a conductive projectile, generates a signal in response to detecting the electrical current, and transmits the signal to a receiving device.

19. The target system of claim 14, wherein said actuator comprises a pneumatic cylinder powered by a source of compressed gas directed through a multiple valve solenoid system, and said pneumatic cylinder is configured for flinching or wiggling said target panel, as well as for moving said target panel between said first and second positions.

* * * * *